US009200822B2

(12) United States Patent
Jeon et al.

(10) Patent No.: US 9,200,822 B2
(45) **Date of Patent: *Dec. 1, 2015**

(54) EVAPORATOR

(71) Applicant: HALLA CLIMATE CONTROL CORP., Daejeon (KR)

(72) Inventors: Young-Ha Jeon, Daejeon (KR); Jun Young Song, Daejeon (KR); Yong Jun Jee, Daejeon (KR); Kwang Hun Oh, Daejeon (KR); Duck-Ho Lee, Daejeon (KR); Jung Sam Gu, Daejeon (KR); Hong-Young Lim, Daejeon (KR)

(73) Assignee: Halla Visteon Climate Control Corp., Daejeon (KR)

( * ) Notice: Subject to any disclaimer, the term of this patent is extended or adjusted under 35 U.S.C. 154(b) by 240 days.

This patent is subject to a terminal disclaimer.

(21) Appl. No.: 13/873,924

(22) Filed: Apr. 30, 2013

(65) Prior Publication Data

US 2013/0312453 A1 Nov. 28, 2013

(30) Foreign Application Priority Data

May 22, 2012 (KR) ..... 10-2012-0053983
May 22, 2012 (KR) ..... 10-2012-0054049

(51) Int. Cl.

| | |
|---|---|
| ***F25B 39/02*** | (2006.01) |
| ***F28F 9/02*** | (2006.01) |
| ***F28F 9/26*** | (2006.01) |
| ***F28D 1/053*** | (2006.01) |
| ***F28F 1/02*** | (2006.01) |
| *F28D 21/00* | (2006.01) |

(52) U.S. Cl.

CPC ..... *F25B 39/028* (2013.01); *F28D 1/05391* (2013.01); *F28F 1/022* (2013.01); *F28F 9/0207* (2013.01); *F28F 9/0246* (2013.01); *F28F 9/26* (2013.01); *F28D 2021/0085* (2013.01)

(58) Field of Classification Search

CPC ..... F25B 39/028; F28F 9/0207; F28F 9/0246; F28F 9/0212; F28F 9/26; F28D 1/0435; F28D 1/05341; F28D 2021/0085

USPC ..... 62/524, 515

See application file for complete search history.

(56) References Cited

U.S. PATENT DOCUMENTS

| | | | | |
|---|---|---|---|---|
| 6,871,508 | B2 * | 3/2005 | Wanami et al. | 62/196.4 |
| 2003/0177775 | A1 * | 9/2003 | Wanami et al. | 62/196.4 |
| 2006/0201198 | A1 * | 9/2006 | Nishino et al. | 62/525 |
| 2008/0099191 | A1 * | 5/2008 | Taras et al. | 165/174 |
| 2008/0141707 | A1 * | 6/2008 | Knight et al. | 62/498 |
| 2010/0031698 | A1 * | 2/2010 | Higashiyama | 62/525 |
| 2010/0071392 | A1 * | 3/2010 | Taras et al. | 62/118 |

(Continued)

FOREIGN PATENT DOCUMENTS

| | | |
|---|---|---|
| EP | 1843115 A2 | 10/2007 |
| EP | 2049859 A1 | 4/2009 |

(Continued)

*Primary Examiner* — Mohammad M Ali

(74) *Attorney, Agent, or Firm* — Novick, Kim & Lee, PLLC; Jae Youn Kim

(57) ABSTRACT

Provided is an evaporator including a flow part having a refrigerant flow therein, separately from a first compartment and a second compartment to improve a refrigerant channel structure, in a double evaporator in which a refrigerant flows in a first column and a second column, respectively, thereby reducing the number of four inlets and outlets that is disposed in the first column and the second column, respectively.

19 Claims, 29 Drawing Sheets

(56) References Cited

U.S. PATENT DOCUMENTS

| | | | | |
|---|---|---|---|---|
| 2010/0206535 | A1* | 8/2010 | Munoz et al. | 165/173 |
| 2011/0239696 | A1* | 10/2011 | Takagi | 62/524 |
| 2011/0315363 | A1* | 12/2011 | Matter et al. | 165/173 |

FOREIGN PATENT DOCUMENTS

| | | | |
|---|---|---|---|
| JP | 2000-62452 | A | 2/2000 |
| JP | 2003-302188 | A | 10/2003 |
| JP | 2005-265233 | A | 9/2005 |
| JP | 2005-308384 | A | 11/2005 |
| JP | 2009-092358 | A | 4/2009 |
| JP | 2012-067994 | A | 4/2012 |
| KR | 10-2008-0075983 | A | 8/2008 |
| KR | 10-2008-0103292 | A | 11/2008 |
| KR | 10-2011-0133983 | A | 12/2011 |

* cited by examiner

- Prior Art -

- Prior Art -

EVAPORATOR

CROSS-REFERENCE TO RELATED APPLICATIONS

This application claims priority under 35 U.S.C. §119 to Korean Patent Application No. 10-2012-0053983, filed on May 25, 2012, and 10-2012-0054049, filed on May 25, 2012 in the Korean Intellectual Property Office, the disclosures of which are incorporated herein by reference in their entirety.

BACKGROUND OF THE INVENTION (1) Field of the Invention

The following disclosure relates to an evaporator including a flow part having a refrigerant flow therein, separately from a first compartment and a second compartment to improve a refrigerant channel structure, in a double evaporator in which a refrigerant flows in a first column and a second column, respectively, thereby reducing the total number of four inlets and outlets that are disposed in the first column and the second column, respectively.

(2) Description of the Related Art

An air conditioner for vehicles is an interior part of a car that is installed for the purpose of cooling or heating an interior of a car during the summer season or the winter season or removing a frost formed on a windshield during rainy weather or winter season, and the like, to allow a driver to secure a front and rear sight. The air conditioner usually includes both of the heating system and the cooling system to optionally introduce external air or internal air, heat or cool the air, and then send the air to an interior of a car, thereby cooling, heating, or ventilating the interior of a car.

A general refrigerating cycle of the air conditioner includes an evaporator that absorbs heat from the surroundings, a compressor that compresses a refrigerant, a condenser that discharges heat to the surroundings, an expansion valve that expands the refrigerant. In the cooling system, the refrigerant in a gaseous state that is introduced into the compressor from the evaporator is compressed at a high temperature and a high pressure by the compressor, liquefaction heat is discharged to the surroundings while the compressed refrigerant in a gaseous state is liquefied by passing through the condenser, the liquefied refrigerant is in a low-temperature and low-pressure wet saturated steam state by again passing through the expansion valve, and is again introduced into the evaporator and vaporized to absorb vaporization heat and cool the surrounding air, thereby cooling the interior of a car.

Numerous researches for allowing representative heat exchangers, such as a condenser, an evaporator, and the like, that are used in the cooling system to more effectively exchange heat between air outside the heat exchanger and a heat exchange medium in the heat exchanger, that is, a refrigerant have been steadily conducted. The most direct effect in cooling the interior of a car is shown in evaporator efficiency. In particular, various structural researches and developments for improving heat exchange efficiency of the evaporator have been conducted.

As one of the improved structures to increase the heat exchange efficiency of the evaporator, a double evaporation structure in which a core including a tube and a pin doubly forms a first column and a second column that are a space in which a refrigerant flows individually is proposed as an example.

As the related art, Japanese Patent Laid-Open Publication No. 2000-062452 ("Air conditioner for vehicles, Feb. 29, 2000), Japanese Patent Laid-Open Publication No. 2005-308384 ("Ejector cycle", Nov. 4, 2005), and the like, disclose a form similar to a double evaporator in which a refrigerant independently flows in the first column and the second column, respectively.

Meanwhile, an example of the evaporator having the double evaporation structure is illustrated in FIGS. 1 and 2. (FIG. 1 is a perspective view of the evaporator and FIG. 2 is a schematic diagram of a flow within the first column and the second column of the evaporator illustrated in FIG. 1)

An evaporator 1 illustrated in FIGS. 1 and 2 is configured to form a first header tank 11 and a second header tank 12 formed in parallel with each other, being spaced apart from each other by a predetermined distance and including at least one baffle 13 that is partitioned by a barrier rib to form a first column and a second column to partition each of a first compartment and a second compartment in a width direction and partition a space in a length direction; a first inlet 41 that is connected with one portion of the first compartment of the first header tank 11 to introduce a flowing refrigerant into the first column and a first outlet 42 that is connected with the other portion of the first compartment of the first header tank 11 to discharge the refrigerant; a second inlet 43 that is connected with the other portion of the second compartment of the first header tank 11 to introduce a flowing refrigerant into the second column and a second outlet that is connected with one portion of the second compartment of the second header tank 12 to discharge the refrigerant; a plurality of tubes 20 of which both ends are fixed to the first header tank 11 and the second header tank 12; and a pin 30 interposed between the tubes 20.

Referring to FIG. 2, in the first column of the evaporator 1, the refrigerant is introduced into the first compartment through the first inlet 41 of the first header tank 11 and flows in the first compartment to the second header tank 12 through the tube 20 and again flows in the first compartment to the first header tank 11 through the remaining tubes 20 and then is discharged through the first outlet 42.

In addition, in the second column, the refrigerant is introduced into the second compartment through the second inlet 43 of the first header tank 11 and flows in the second compartment to the second header tank 12 through the tube 20 and again flows back to the first header tank 11 through the remaining tubes 20 and is discharged through the second outlet.

In other words, in the evaporator 1 illustrated in FIGS. 1 and 2, the refrigerants of the first column and the second column flow individually. To this end, two inlets 41 and 43 and two outlets 42 and 44 are required for introducing and discharging the refrigerant into and from the first column and the second column.

Therefore, in the evaporator having the double evaporation structure, four pipes forming the inlets and the outlets are needed to be connected with one another, and therefore manufacturing costs for manufacturing and fixing them would increase. In particular, as illustrated in FIG. 1, in case of using a separate pipe fixing part for connecting and fixing the four pipes, the foregoing problem would be more serious.

Further, in the evaporator having the double evaporation structure, the pipe itself takes up a lot of interior space of an engine room to hinder the miniaturization of the evaporator and reduce a heat exchange region as much, thereby degrading the cooling performance.

Therefore, a need exists for a development of an evaporator having a high heat exchange efficiency, high manufacturing performance, and miniaturization.

RELATED ART DOCUMENT

Patent Document

Patent Document 1) Japanese Patent Laid-Open Publication No. 2000-062452 ("Air conditioner for vehicles", Feb. 29, 2000)

Patent Document 2) Japanese Patent Laid-Open Publication No. 2005-308384 ("Ejector cycle", Nov. 4, 2005)

BRIEF SUMMARY OF THE INVENTION

An exemplary embodiment of the present invention is directed to providing an evaporator with the improved refrigerant channel structure using a flow part in a double evaporator in which a refrigerant independently flows in a first column and a second column, respectively, to solve a problem of degradation of productivity and difficulty of miniaturization due to an increase in the number of inlets and outlets.

In one general aspect, there is provided an evaporator 1000, including: a first header tank 100 and a second header tank 200 formed in parallel with each other, being spaced apart from each other by a predetermined distance and including at least one baffle 130 that is partitioned by a barrier rib 111 to form a first column and a second column to partition each of the first compartments 100*a* and 200*a* and the second compartments 100*b* and 200*b* in a width direction and partitions a space in a length direction; a plurality of tubes 300 of which both ends are fixed to the first header tank 100 and the second header tank 200; and a pin 400 interposed between the tubes 300, wherein the first header tank 100 is lengthily formed with a flow part 100*c* in a length direction, separately from the first compartment 100*a* and the second compartment 100*b*.

The first header tank 100 may include: a first inlet 510 connected with one portion of the first compartment 100*a* to introduce a refrigerant; an outlet 520 connected with the other portion of the first compartment 100*a* to discharge the refrigerant; and a second inlet 530 connected with the other portion of the second compartment 100*b* to introduce the refrigerant, wherein the flow part 100*c* may be provided with a first communication hole 122 that is adjacent to a formation region of the first inlet 510 in a length direction to communicate with the second compartment 100*b* and a second communication hole 123 that is adjacent to a formation region of the outlet 520 and the second inlet 530 in a length direction to communicate with the first compartment 100*a*.

The evaporator 1000 may further include: in the first column, a 1-1-th region A1-1 where the refrigerant introduced into the first compartment 100*a* of the first header tank 100 through the first inlet 510 moves to the first compartment 200*a* of the second header tank 200 through the tube 300 and a 1-2-th region A1-2 in which the refrigerant of the first compartment 200*a* of the second header tank 200 moves to the first compartment 100*a* of the first header tank 100 through the tube 300; and in the second column, a 2-1-th region in which the refrigerant introduced into the second compartment 100*b* of the first header tank 100 through the second inlet 530 moves to the second compartment 200*b* of the second header tank 200 through the tube 300 and a 2-2-th region in which the refrigerant of the second compartment 200*b* of the second header tank 200 moves to the second compartment 100*b* of the first header tank 100 through the tube 300, and the refrigerant passing through both of the 2-1-th region A2-1 and the 2-2-th region of the second column may move to the flow part 100*c* through the first communication hole 122 and move in a length direction and may be joined with the refrigerant discharged through the 1-1-th region A1-1 and the 1-2-th region A1-2 of the first column through the second communication hole 123 to be discharged through the outlet 520.

The first header tank 100 may be formed by the coupling of the header 110 and the tank 120.

The tank 120 of the first header tank 100 may be formed in a width direction and includes a depressed part 121 that is lengthily formed in a length direction, in which the central region formed with the barrier rib 11 is depressed, and the first header tank 100 may include a first formation member 160 provided to cover the depressed part 121 of the tank 120, so that a portion surrounded by the depressed part 121 of the tank 120 and a first formation member 160 form the flow part 100*c*.

The tank 120 may be inclined to the barrier rib 111 so that the depressed part 121 has a "Y"-letter shape along with the barrier rib 111.

In the tank 120, at least one first protruded bead 124 that is protruded to the flow part 100*c* to support the first formation member 160 may be formed at the depressed part 121.

In the first header tank 100, the first formation member 160 may be provided with extensions 161 that extend to contact at least two of the surfaces of the first protruded beads 124 vertically to the length direction of the first header tank 100.

Both ends of the first header tank 100 may be provided with an end cap 150 including a plate part 151 and a support part 151*a* that is protruded in a form in which a predetermined region of the plate part 151 corresponds to a space of the flow part 100*c* to support the first formation member 160.

One of the end caps 150 disposed at both ends of the first header tank 100 may be provided with a first hollow hole 152 of which the predetermined region corresponding to the first compartment 100*a* in a predetermined region of the plate part 151 is hollowed and a second hollow hole 153 of which the predetermined region corresponding to the second compartment 100*b* in the predetermined region of the plate part 151 is hollowed, and the other one of the end caps 150 may be provided with a third hollow hole 154 of which the predetermined region corresponding to the first compartment 100*a* in the predetermined region of the plate part 151 is hollowed.

The first header tank 100 may form the flow part 100*c*, including a second formation member 170 that partitions one portion or both portions of the first compartment 100*a* and the second compartment 100*b* formed by the coupling of the header 110 and the tank 120 in a height direction.

The second formation member 170 may include: a partition plate 171 that partitions one portion or both portions of the first compartment 100*a* and the second compartment 100*b* in a height direction; and a support surface 172 that extends from the partition plate 171 to be adhered to the barrier rib 111 and an inner surface of the tank 120.

The header 110 of the first header tank 100 may be further provided with a second protruded bead 113 that is protruded so as to support the second formation member 170.

In the first header tank 100, the support surface 172 of the second formation member 170 may be adhered to the inner surface of the tank 120 and a bent part 173 bent so that the predetermined region of the end surrounds the end of the tank 120 is formed.

The second formation member 170 may extend from the tank 120.

The second formation member 170 may extend from the header 110.

In the first header tank 100, a partition plate of the second formation member 170 that extends from the header 110 may be provided with a tank fixing groove 174 and both ends of the tank 120 may be inserted into the tank fixing groove 174.

The first header tank 100 may include a third formation member 180 coupled with an outer surface of the tank 120 to form the flow part 100*c* formed therein.

The first header tank 100 may be formed in an extrusion tank type.

Figure 1:
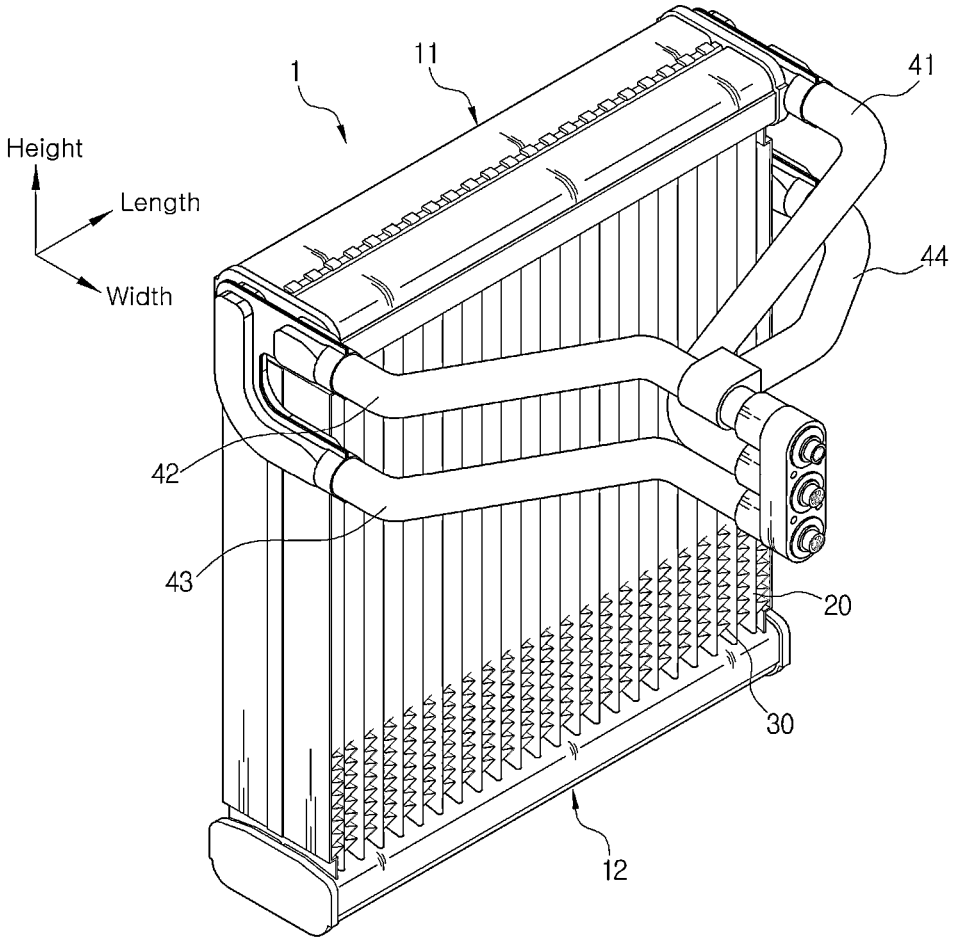
FIG. 1 is a perspective view illustrating an evaporator having a double evaporation structure according to the related art.
Figure 2:
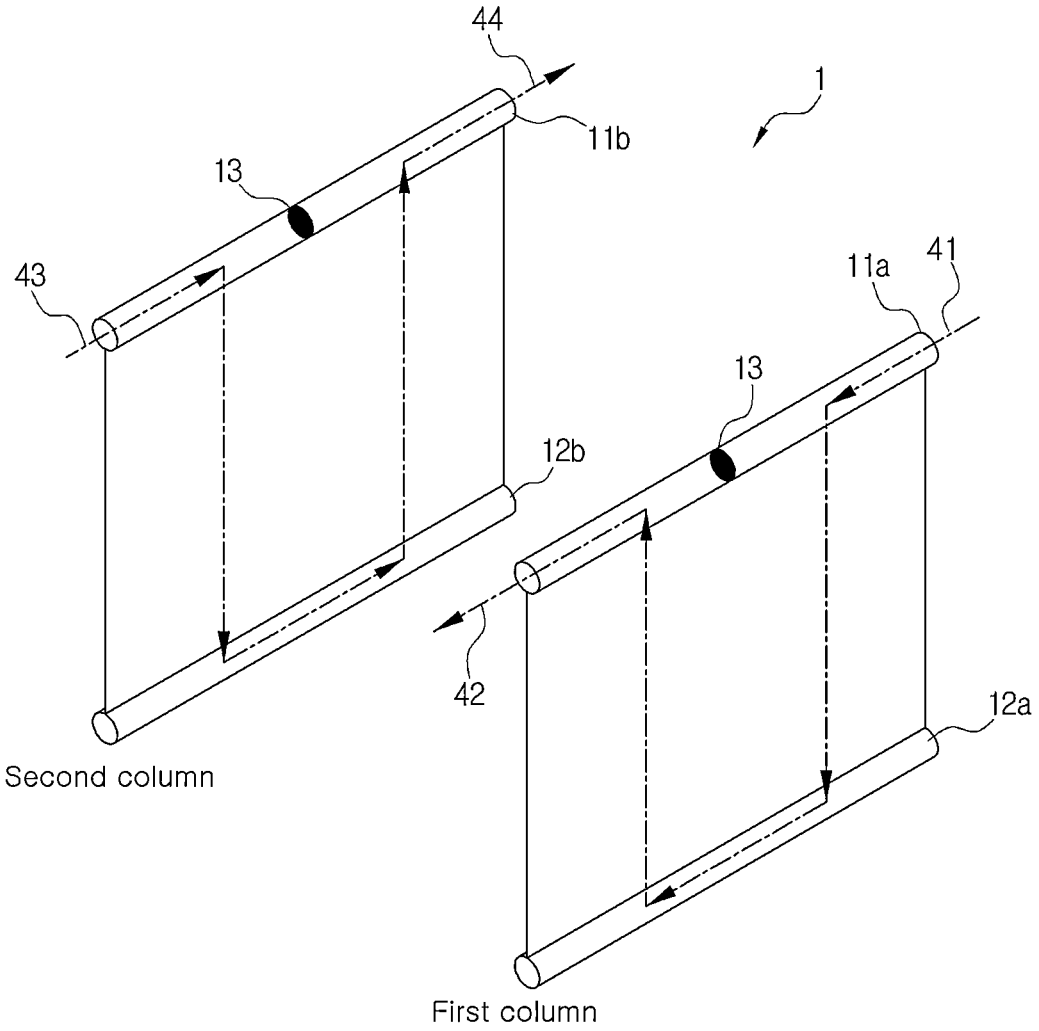
FIG. 2 is a schematic view illustrating a refrigerant flow within the evaporator illustrated in FIG. 1.

| [Detailed Description of Main Elements] | |
|---|---|
| 1000: Evaporator | |
| 100: First header tank | |
| 100a: First compartment | 100b: Second compartment |
| 100c: Flow part | 101: Third communication hole |
| 110: Header | 111: Barrier rib |
| 112: Tube insertion hole | 113: Second protruded bead |
| 114: First fixed groove | |
| 120: Tank | 121: Depressed part |
| 122: First communication hole | 123: Second communication hole |
| 124: First protruded bead | |
| 125: Second fixed groove | 126: Third fixed groove |
| 130: Baffle | 131: First protruded part |
| 132: Barrier rib insertion groove | |

-continued

| [Detailed Description of Main Elements] | |
|---|---|
| 150: End cap | 151: Plate part |
| 151a: Support part | |
| 152: First hollow hole | 153: Second hollow hole |
| 154: Third hollow hole | |
| 160: First formation member | 161: Extension |
| 170: Second formation member | 171: Partition plate |
| 172: Support surface | 172-1: Correspondence part |
| 173: Bent part | 174: Tank fixing groove |
| 175: Second protruded part | |
| 180: Third formation member | |
| 200: Second header tank | |
| 200a: First compartment | 200b: Second compartment |
| 300: Tube | |
| 400: Pin | |
| 510: First inlet | 520: Outlet |
| 530: Second inlet | |
| A1-1: 1-1-th region | A1-2: 1-2-th region |
| A2-1: 2-1-th region | A2-2: 2-2-th region |

DETAILED DESCRIPTION OF THE INVENTION

Hereinafter, an evaporator 1000 according to the present disclosure having the above-mentioned characteristics will be described in more detail with reference to the accompanying drawings.

The evaporator 1000 according to the present invention includes a first header tank 100, a second header tank 200, tubes 300, and a pin 400, in which the first header tank 100 is provided with a flow part 100*c*.

First, the first header tank 100 and the second header tank 200 are formed in parallel with each other, being spaced apart from each other by a predetermined distance, have a space in which a refrigerant flows, and fix both ends of the tube 300.

The first header tank 100 and the second header tank 200 respectively include at least one baffle 130 that is partitioned by a barrier rib 111 to form a first column and a second column to partition each of the first compartments 100*a* and 200*a* and the second compartments 100*b* and 200*b* in a width direction and partitions a space in a length direction.

The baffle 130 is configured to partition an interior space of the first compartments 100*a* and 200*a* and the second compartments 100*b* and 200*b* in a length direction to control a refrigerant flow therein.

In the present invention, the first compartment in the first header tank 100 is represented by reference numeral 100*a*, the second compartment in the first header tank 100 is represented by reference numeral 100*b*, the first compartment 200*a* in the second header tank 200 is represented by reference numeral 200*a*, and the second compartment 200*b* in the second header tank 200 is represented by reference numeral 200*b*.

The evaporator 1000 according to the present invention has a configuration in which a flow part 100*c* is formed in the first header tank 100 but can be variously practiced and an example thereof will be described again.

The tube 300 has a configuration of forming a refrigerant channel of which both ends are fixed to the first header tank 100 and the second header tank 200 and the tube 300 forms two columns, including a column that communicates with the first compartments 100*a* and 200*a* of the first header tank 100 and the second header tank 200 and a column that communicates with the second compartments 100*b* and 200*b* of the first header tank 100 and the second header tank 200.

The pin 400 is interposed between the tubes 300.

In addition, in the evaporator 1000 according to the present invention, the first header tank 100 may include a first inlet 510, an outlet 520, and a second inlet 530.

In more detail, in the first header tank 100 the first inlet 510 that introduces a refrigerant into the first column is disposed at one portion of the first compartment 100*a* so that the refrigerant flows in the first column and the outlet 520 is disposed at the other portion of the first compartment 100*a* to discharge a refrigerant in the first column, and the second inlet 530 that introduces a refrigerant into the second column is disposed at the other portion of the second compartment 100*b*.

The flow part 100*c* serves to deliver the refrigerant moving to the second column 100*b* of the first header tank 100 by passing through the second column to the first compartment 100*a* so as to be discharged together with the refrigerant passing through the first column. To this end, the flow part 100*c* is provided with a first communication hole 122 that is adjacent to a region in which the first inlet 510 is formed in a length direction so as to communicate with the second compartment 100*b* and a second communication hole 123 that is adjacent to a region in which the outlet 520 and the second inlet 530 are formed in a length direction so as to communicate with the first compartment 100*a*.

In more detail, describing the flow in the evaporator 1000 according to the present invention, the evaporator 1000 includes, in the first column, a 1-1-th region A1-1 that the refrigerant introduced into the first compartment 100*a* of the first header tank 100 through the first inlet 510 moves to the first compartment 200*a* of the second header tank 200 through the tube 300 and a 1-2-th region A1-2 in which the refrigerant of the first compartment 200*a* of the second header tank 200 moves to the first compartment 100*a* of the first header tank 100 through the tube 300 and in the second column, a 2-1-th region in which the refrigerant introduced into the second compartment 100*b* of the first header tank 100 through the second inlet 530 moves to the second compartment 200*b* of the second header tank 200 through the tube 300 and a 2-2-th region in which the refrigerant of the second compartment 200*b* of the second header tank 200 moves to the second compartment 100*b* of the first header tank 100 through the tube 300, in which the refrigerant passing through both of the 2-1-th region A2-1 and the 2-2-th region of the second column moves to the flow part 100*c* through the first communication hole 122 and moves in a length direction and is joined with the refrigerant discharged through the 1-1-th region A1-1 and the 1-2-th A1-2 of the first column through the second communication hole 123 to be discharged through the outlet 520.

In this case, the 1-1-th region A1-1, the 1-2-th region A1-2, the 2-1-th region A2-1, and the 2-2-th region A2-2 may each be formed once according to the formation position and number of baffle 130.

That is, the flow part 100*c* of the first header tank 100 is a space in which the refrigerant passing through the inside of the second column moves and flows and the refrigerant passing through the space of the flow part 100*c* is joined with the refrigerant passing through the inside of the first column, which is in turn discharged.

As a result, in the case in which the evaporator 1000 according to the present invention has the double evaporation structure of the first column and the second column, the outlet 520 may be integrated and thus the number of connection pipe lines may be more reduced, such that the evaporator 1000 may be miniaturized.

The first header tank 100 may be formed by various methods. First, a configuration formed by a combination of the header 110 and the tank 120 will be described.

FIGS. 3 to 6 are a perspective view of the evaporator 1000 according to the present invention and an exploded perspective view, a cross-sectional view, and a plan view of the first header tank 100, respectively, and, in the evaporator 1000 according to the present invention illustrated in FIGS. 3 to 6, an example, in which the first header tank 100 is formed by a combination of the header 110 and the tank 120, the tank 120 is provided with a depressed part 121, and the flow part 100*c* is formed using a first formation member 160 covering the depressed part 121, is illustrated.

First, the header 110 is provided with a tube insertion hole 112 into which a predetermined region of the tube 300 is inserted and is coupled with the tank 120 to form the first compartments 100*a* and 200*a* and the second compartments 100*b* and 200*b* therein.

Figure 3:
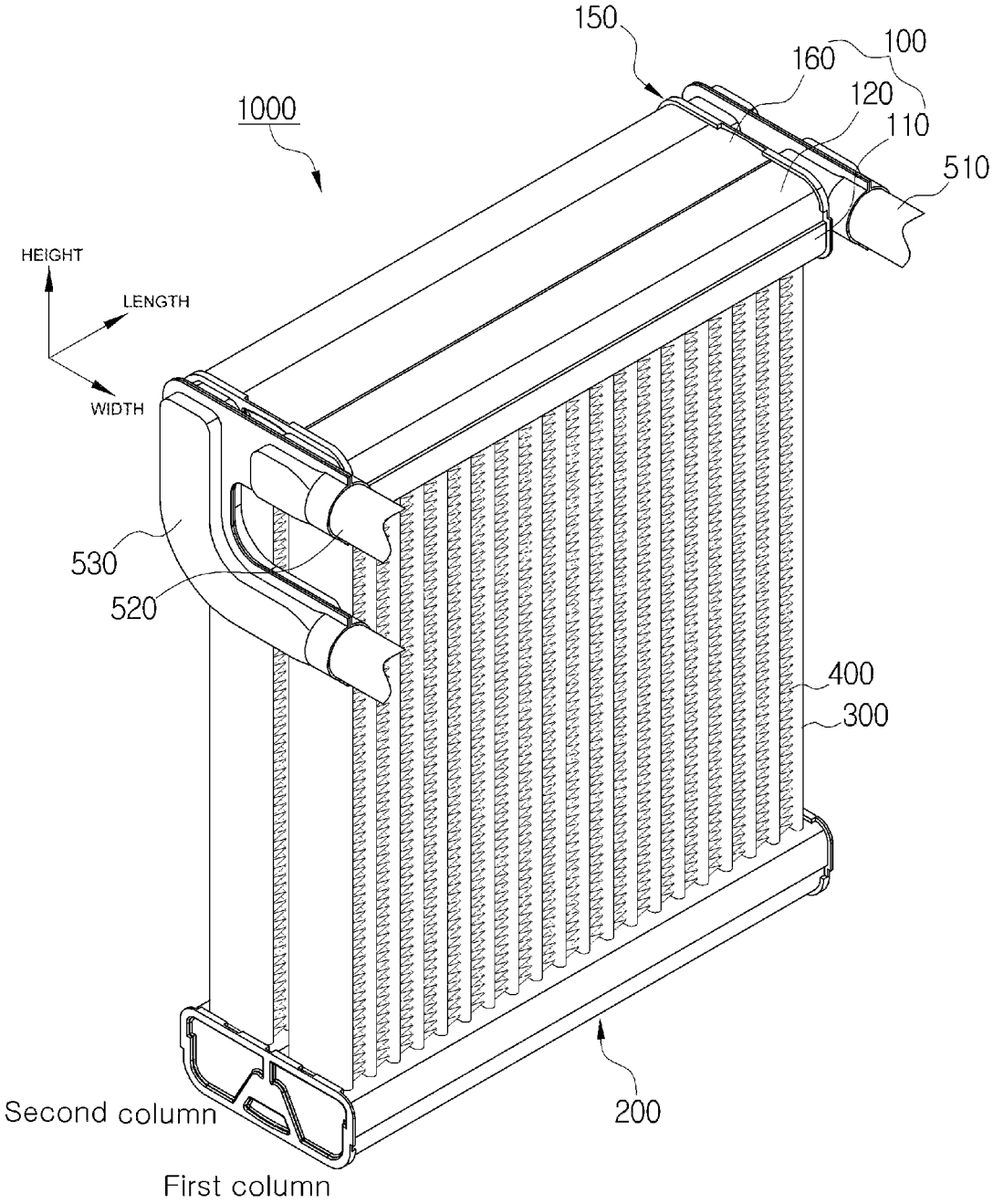
FIGS. 3 to 6 are a perspective view of an evaporator according to the present invention and an exploded perspective view, a cross-sectional view, and a plan view of a first header tank.
Figure 4:
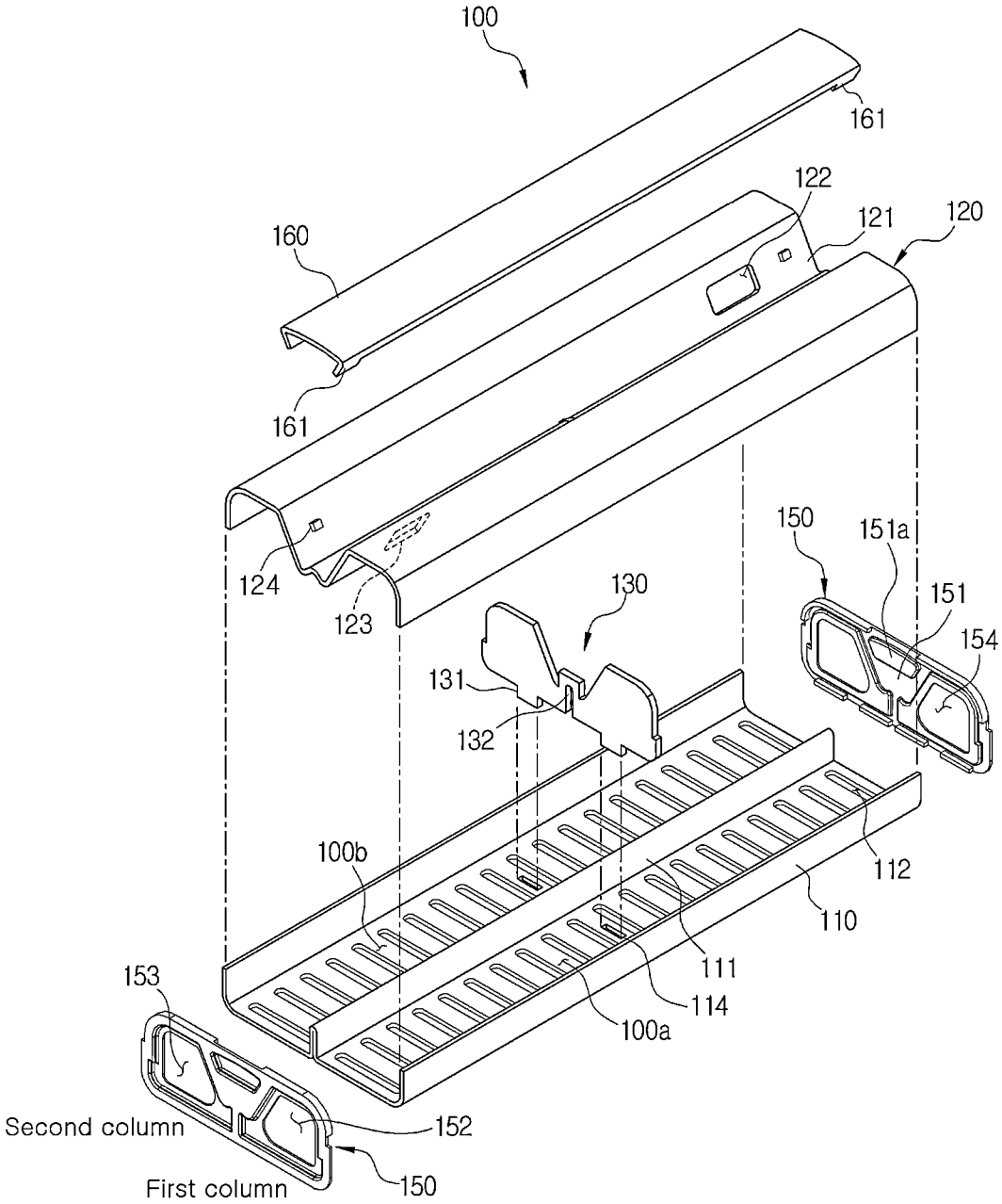
Figure 5:
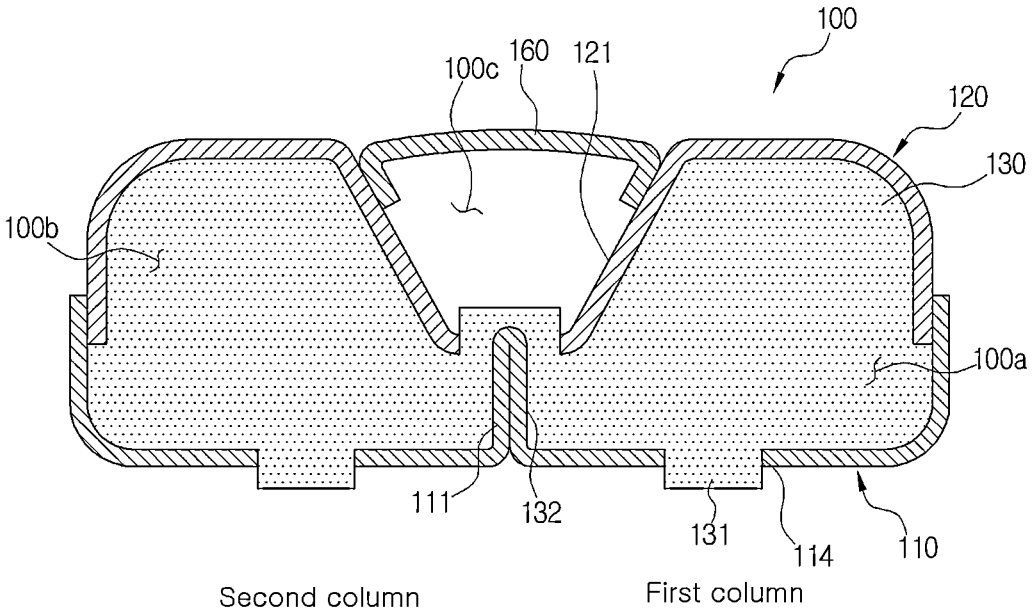

FIGS. 3 and 4 illustrate an example in which the barrier rib 111 is integrally formed with the header 110, but the evaporator 1000 according to the present invention is not limited thereto.

In more detail, the first header tank 100 is provided with the tank 120 in a width direction and longitudinally formed with the depressed part 121 of which the central region formed with the barrier rib 111 is depressed.

The first formation member 160 is provided to cover the depressed part 121 of the tank 120 and is configured to form the flow part 100*c* in which a refrigerant flows, separately from the first compartment 100*a* and the second compartment 100*b*.

That is, the first formation member 160 is configured to be coupled with the tank 120 and form the space of the flow part 100*c* at a position depressed by the depressed part 121 and components forming the first header tank 100 are temporarily assembled and then may be integrally formed by a final brazing process.

In this case, in the tank 120 of the first header tank 100, the depressed part 121 may be formed with at least one first protruded bead 124 that is protrude to the flow part 100*c* to support the first formation member 160.

The first protruded bead 124 may support the first formation member 160 to determine an assembly depth of the first formation member 160 in a height direction.

Further, the first formation member 160 may be formed with extensions 161 that extend to contact at least two of the surfaces of the first protruded beads 124 vertically to the length direction of the first header tank 100.

That is, the extensions 161 of the first formation member 160 may be adhered to at least two first protruded beads 124 to prevent the first formation member 160 from moving in a length direction and accurately hold the assembly position.

Figure 6:
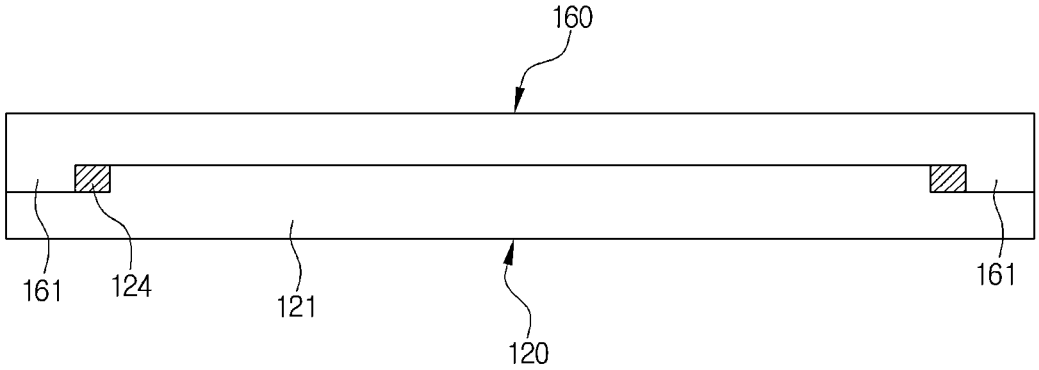

FIG. 6 illustrates an example in which the first protruded bead 124 is disposed at two places in a length direction and the extensions 161 protruded to the first protruded beads 124 are each disposed at both ends of the first formation member 160.

Figure 7A:
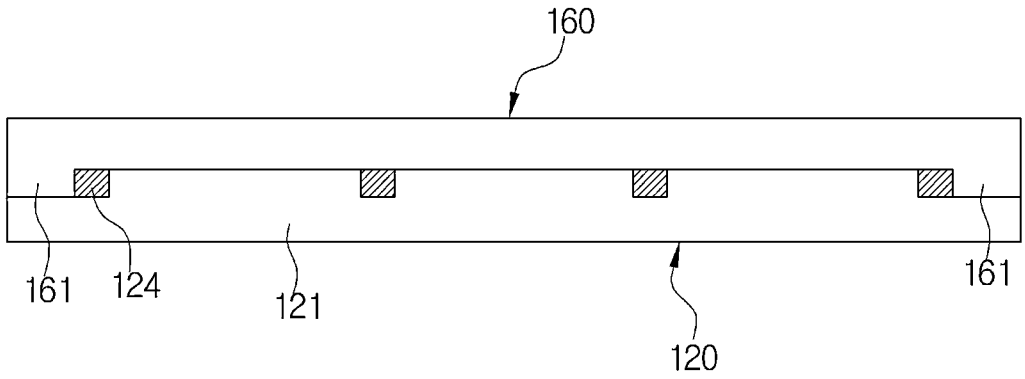
FIG. 7A to 7C are a diagram illustrating various embodiments of a first formation member and first protruded beads of the evaporator according to the present invention.
Figure 7B:
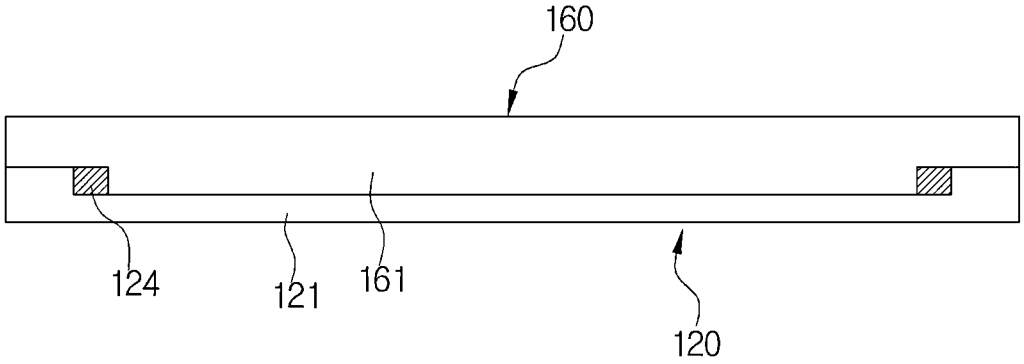
Figure 7C:
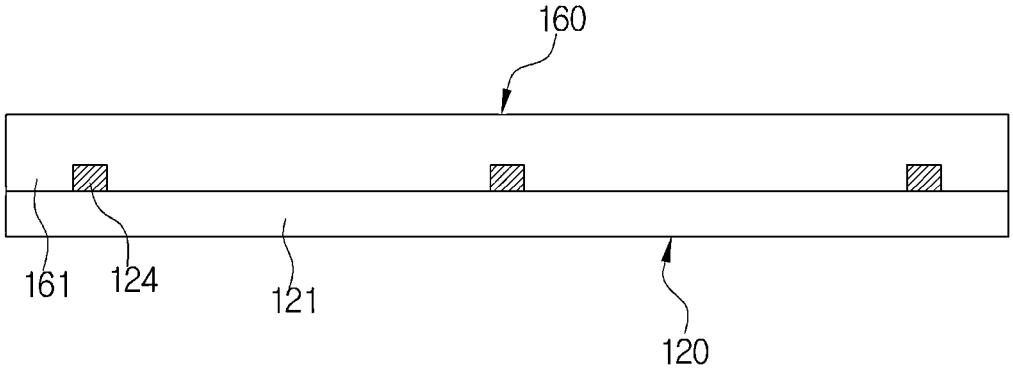

FIG. 7A to 7C illustrate various embodiments of the first protruded bead 124 and a first formation member 160 and FIG. 7A illustrates an example similar to the example illustrated in FIG. 6, but an example in which four first protruded beads 124 are formed in a length direction.

In addition, FIG. 7B illustrates an example in which the first protruded bead 124 is disposed at two places in a length direction and one extension 161 is formed so that the first formation member 160 corresponds to a region between the first protruded beads 124 and FIG. 7C illustrates an example in which the first protruded bead 124 is disposed at three places in a length direction and the extension 161 is formed so as to correspond to both ends of the first formation member 160 and the region between the first protruded beads 124.

In addition to the examples illustrated in the drawings, in the evaporator 1000 according to the present invention the number and shape of first protruded beads 124 may be formed more variously and the extension 161 may also be formed more variously.

The evaporator 1000 according to the present invention may have more improved durability by forming the first protruded bead 124 in the depressed part 121 and may have more improved assembly performance by using the first formation member 160 formed with the extension 161 to stably hold the temporary assembling state of the first formation member 160 at an accurate position prior to the brazing process.

In this case, the first communication hole 122 through which the second compartment 100*b* and the flow part 100*c* communicate with each other and the second communication hole 123 through which first compartment 100*a* and the flow part 100*c* communicate with each other are formed in the depressed part 121 and the first communication hole 122 is disposed at a portion formed with the first inlet 510 in a length direction so as to deliver all the refrigerants flowing in the second column to the flow part 100*c* and the second communication hole 123 is disposed at a portion formed with the outlet 520 in a length direction so as to smoothly discharge the refrigerant moving through the length direction of the flow part 100*c* along with the refrigerant passing through the first column.

Further, the tank 120 of the first header tank 100 may be inclined to the barrier rib 111 so that the depressed part 121 has a "Y"-letter shape along with the barrier rib 111.

As a result, the evaporator 1000 according to the present invention may more smooth the refrigerant flow in the first compartment 100*a*, the second compartment 100*b*, and the flow part 100*c* that are included in the first header tank 100 and may sufficiently secure the formation area of the first communication hole 122 through which the second compartment 200*b* and the flow part 100*c* communicate with each other and the second communication hole 123 through which the first compartment 100*a* and the flow part 100*c* communicate with each other.

In this case, the first header tank 100 may have end caps 150 disposed at both ends thereof and a shape of the first inlet 510, the outlet 520, and the second inlet 530 may be more variously formed, in addition to the illustrated example.

A plate part 151 of the end cap 150 has a plate shape to block both ends of the first header tank 100 and is provided with a structure to be easily coupled with an inner circumferential surface or an outer circumferential surface of the first header tank 100.

The evaporator 1000 according to the present invention may have a structure in which the end cap 150 is provided with the plate part 151 and a support part 151*a*.

In this case, the end cap 150 may be formed with the support part 151*a* that is protruded in a form in which a predetermined region of the plate part 151 corresponds to the space of the flow part 100*c* to support the first formation member 160.

That is, the support part 151*a* is configured to support the first formation member 160 along with the first protruded bead 124 formed in the depressed part 121 and both ends of the first formation member 160 are supported by the end cap 150, and an inner side portion of the first formation member 160 is supported by the support part 151*a* to prevent the first formation member 160 from moving, including the width direction and the height direction and widen a welding region, thereby more increasing the durability.

Figure 8:
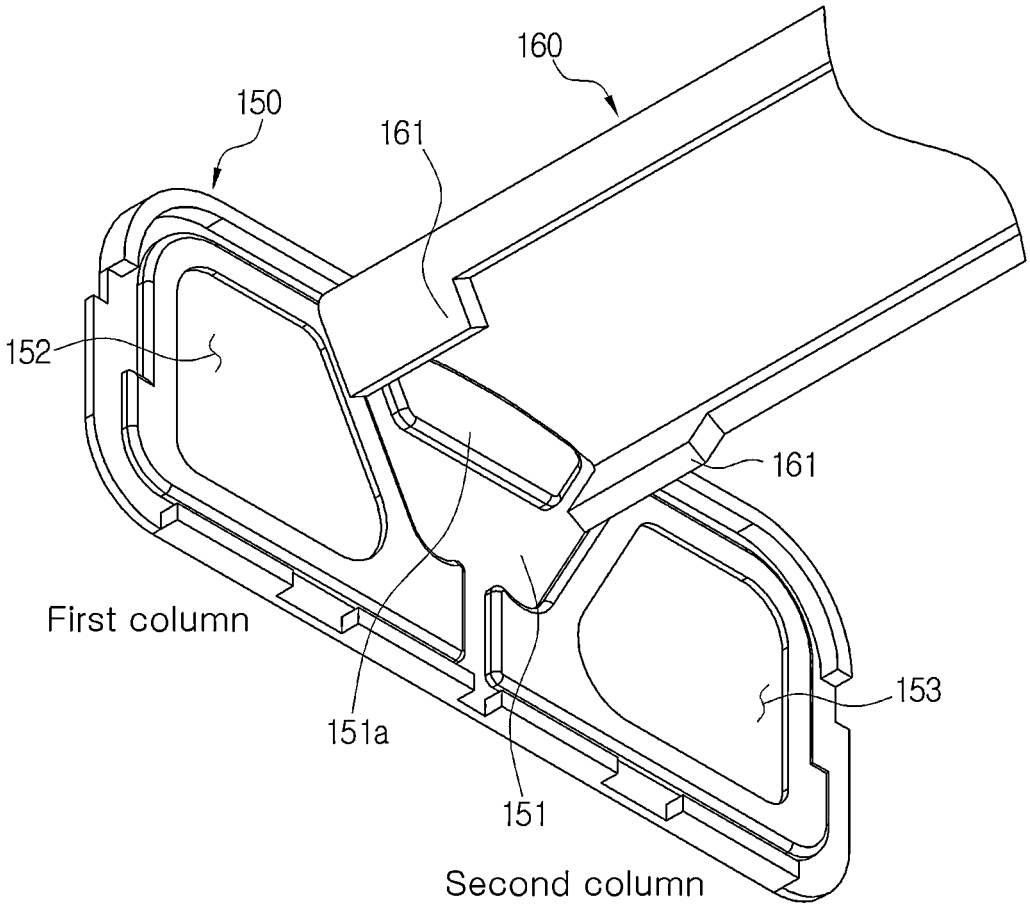
FIG. 8 is a diagram illustrating in detail an end cap of the evaporator according to the present invention.

Further, one of the end caps 150 disposed at both ends of the first header tank 100 is provided with a first hollow hole 152 and a second hollow hole 153. See FIG. 8, which illustrates the end cap 150 that is shown in the left of FIG. 4.

FIG. 4 illustrates an example in which the end cap 150 in which the first hollow hole 152 and the second hollow hole 153 are formed is positioned at the left and an example in which the first hollow hole 152 communicates with the outlet 520 and the second hollow hole 153 communicates with the second inlet 530.

In addition, in FIG. 4, the end cap 150 closing the right portion of the first header tank 100 is provided with a third hollow hole 154 that communicates with the first inlet 510 by perforating a predetermined region corresponding to the first compartment 100*a*.

In more detail, the first hollow hole 152 and the second hollow hole 153 are disposed at one of a pair of the end caps 150 that is disposed at both ends of the first header tank 100 and the first hollow hole 152 is a portion at which the predetermined region corresponding to the first compartment 100*a* in the predetermined region of the plate part 151 is hollowed and the second hollow hole 153 is a portion in which the predetermined region corresponding to the second compartment 100*b* in the predetermined region of the plate part 151 is hollowed.

Further, the third hollow hole 154 is disposed at the remaining one of the pair of end caps 150 that is disposed at both ends of the first header tank 100 and the third hollow hole 154 is a portion in which the predetermined region corresponding to the first compartment 100*a* in the predetermined region of the plate part 151 is hollowed.

A portion of the end cap 150 (end cap 150 disposed at the right of FIG. 4) formed with the third hollow hole 154 that corresponds to the second compartment 100*b* is in a closed state. That is, the end cap 150 closes one portion (the right of FIG. 4) of the second compartment 100*b* and the refrigerant introduced into the second compartment 100*b* through the second inlet 530 moves to the flow part 100*c* through the first communication hole 122. The detailed refrigerant flow will be described below.

Figure 9:
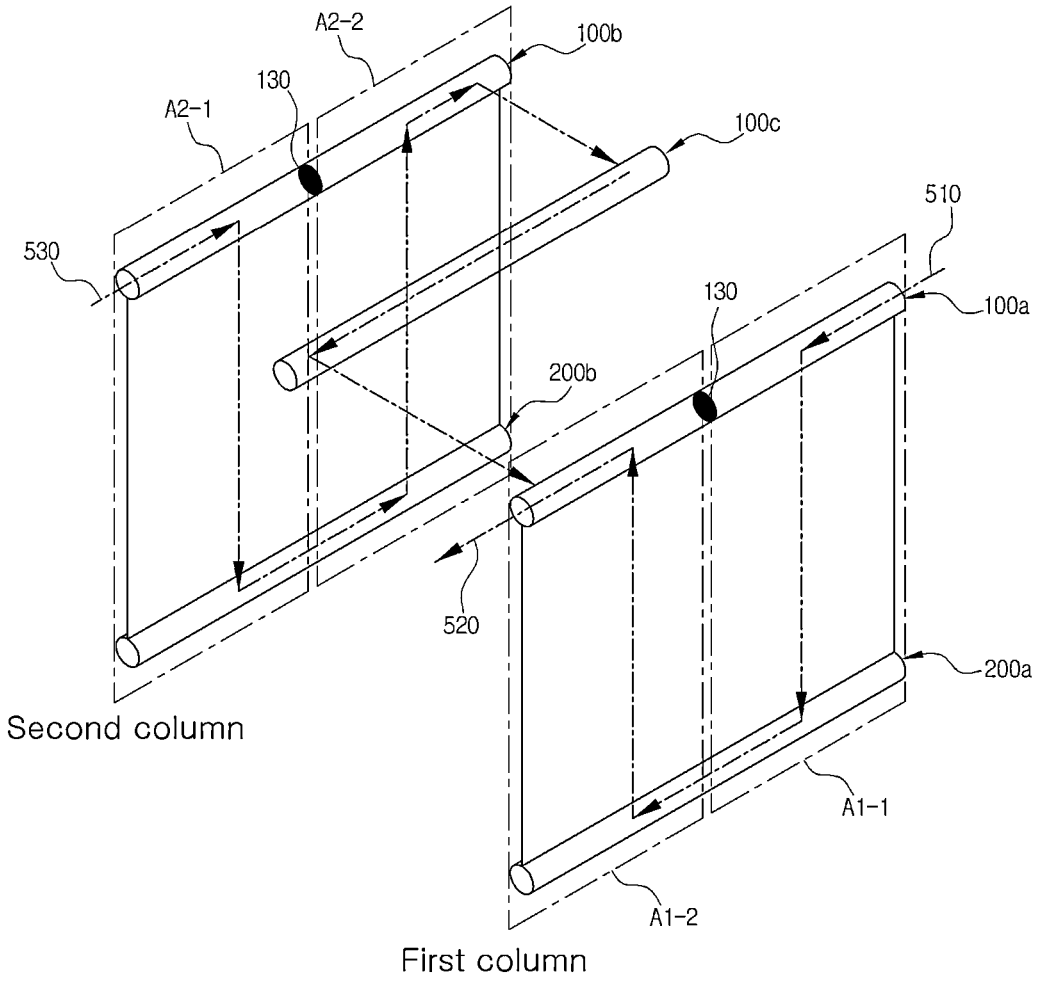
FIGS. 9 and 10 each are diagrams schematically illustrating an example of a refrigerant flow of the evaporator according to the present invention illustrated in FIG. 3.
Figure 10:
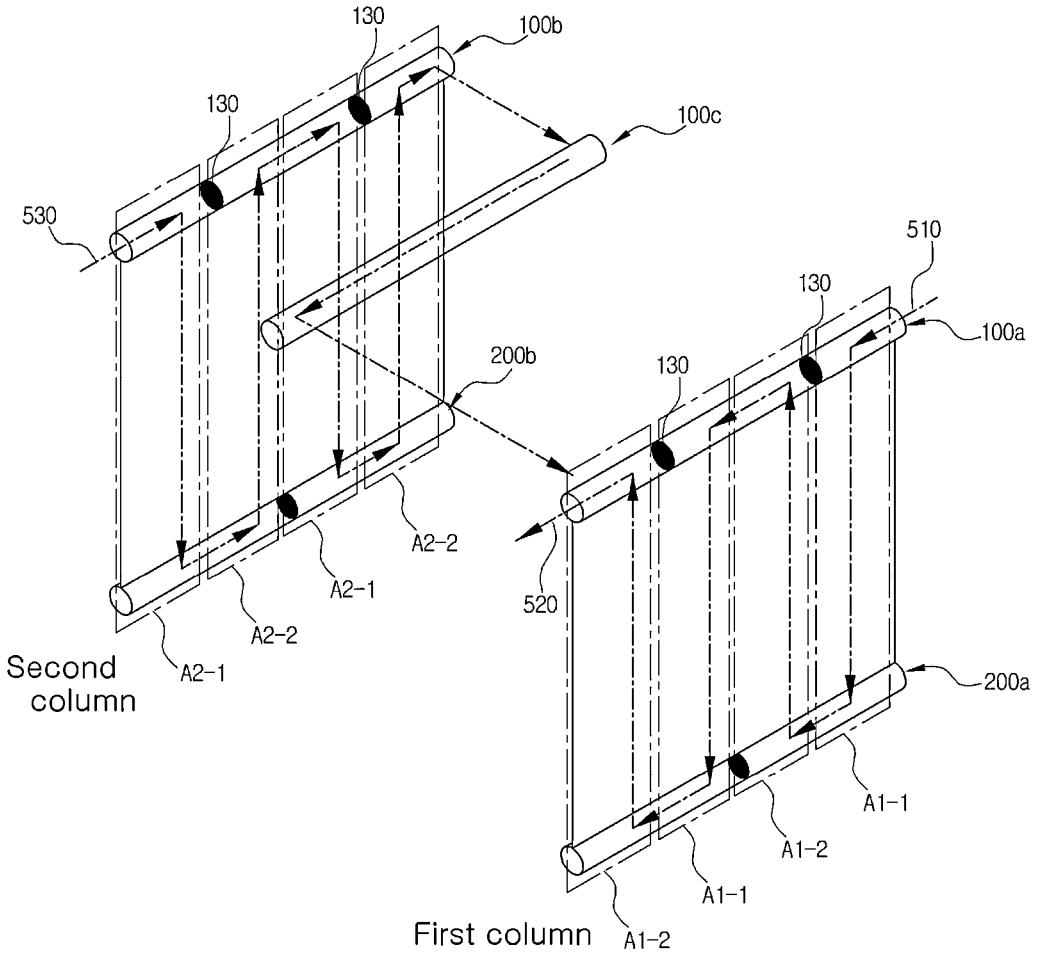

FIGS. 9 and 10 are diagrams illustrating the detailed refrigerant flow of the evaporator 1000 according to the present invention and FIG. 9 illustrates a flow in which the 1-1-th region A1-1 and the 1-2-th region A1-2 are each formed once and the 2-1-th region and the 2-2-th region A2-2 are each formed once.

In more detail, FIG. 9 illustrates a flow in which in the first column, the refrigerant introduced through the first inlet 510 passes through the 1-1-th region A1-1 (the first compartment 100*a* of the first header tank 100→the first compartment 200*a* of the second header tank 200)—the 1-2-th region A1-2 (the first compartment 200*a* of the second header tank 200→the first compartment 100*a* of the first header tank 100) and is discharged and in the second column, the refrigerant introduced through the second inlet 530 passes through the 2-1-th region A2-1 (the second compartment 100*b* of the first header tank 100→the second compartment 200*b* of the second header tank 200)—the 2-2-th region A2-2 (the second compartment 200*b* of the second header tank 200→the first compartment 100*a* of the first header tank 100), moves to the flow part 100*c* through the first communication hole 122, and is joined with the refrigerant discharged from the inside of the first column through the second communication hole 123 and is discharged.

In the evaporator 1000 according to the present invention illustrated in FIGS. 3 to 6, an example, in which the inside of the first header tank 100 is provided with one baffle 130, the baffle 130 is provided with a first protrusion 131, two places of the header 110 are provided with first fixed grooves 114 that fix the first protrusion 131, and the baffle 130 is provided with a barrier rib insertion groove 132 into which the barrier rib 111 of the header 110 is inserted, is illustrated, which is one embodiment, and therefore the shape, number, fixing method, and the like of the baffle 130 may be more variously formed.

Further, FIG. 10 illustrates a flow in which the 1-1-th region A-1 and the 1-2-th region A1-2 are each formed twice and the 2-1-th region and the 2-2-th region A2-2 are each formed twice.

FIG. 10 illustrates a structure in which in the first column, the refrigerant introduced through the first inlet 510 passes through the 1-1-th region A1-1 (the first compartment 100*a* of the first header tank 100→the first compartment 200*a* of the second header tank 200)—the 1-2-th region A1-2 (the first compartment 200*a* of the second header tank 200→the first compartment 100*a* of the first header tank 100)—the 1-2-th region A1-2 (the first compartment 200*a* of the second header tank 200→the first compartment 100*a* of the first header tank 100) and is discharged and in the second column, the refrigerant introduced through the second inlet 530 passes through the 2-1-th region A2-1 (the second compartment 100*b* of the first header tank 100→the second compartment 200*b* of the second header tank 200)—the 2-2-th region A2-2 (the second compartment 200*b* of the second header tank 200→the first compartment 100*a* of the first header tank 100)—the 2-1-th region A2-1 (the second compartment 100*b* of the first header tank 100→the second compartment 200*b* of the second header tank 200)—the 2-2 region A2-2 (the second compartment 200*b* of the second header tank 200→the first compartment 100*a* of the first header tank 100), moves to the flow part 100*c* through the first communication hole 122, and is joined with the refrigerant discharged from the first column through the second communication hole 123 and is discharged.

Therefore, the evaporator 1000 according to the present invention relates to the double evaporator 1000 in which the refrigerant flows in the first column and the second column, respectively, in which the refrigerant channel structure may be improved by forming the depressed part 121 in the tank 120 forming the first header tank 100 and forming the flow part 100*c* having the refrigerant flow therein using the first formation member 160, separately the first compartment 100*a* and the second compartment 100*b*, such that each of the first column and the second column is provided with the inlet and the outlet 520, thereby reducing the total number of four inlets and outlets that are disposed in the first column and the second column, respectively.

Figure 11:
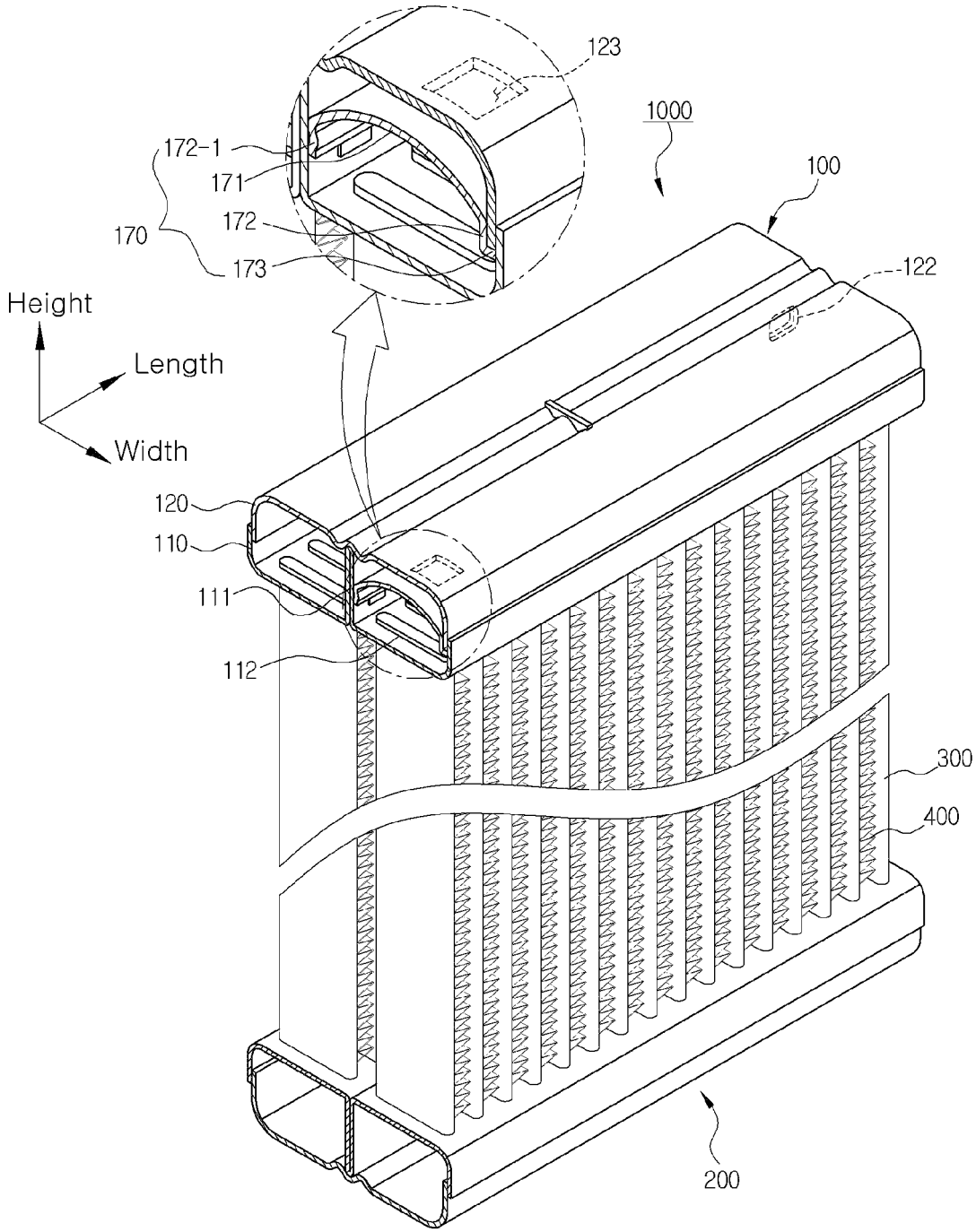
FIGS. 11 and 12 are another perspective view of an evaporator according to the present invention and a cross-sectional view of the first header tank.
Figure 12:
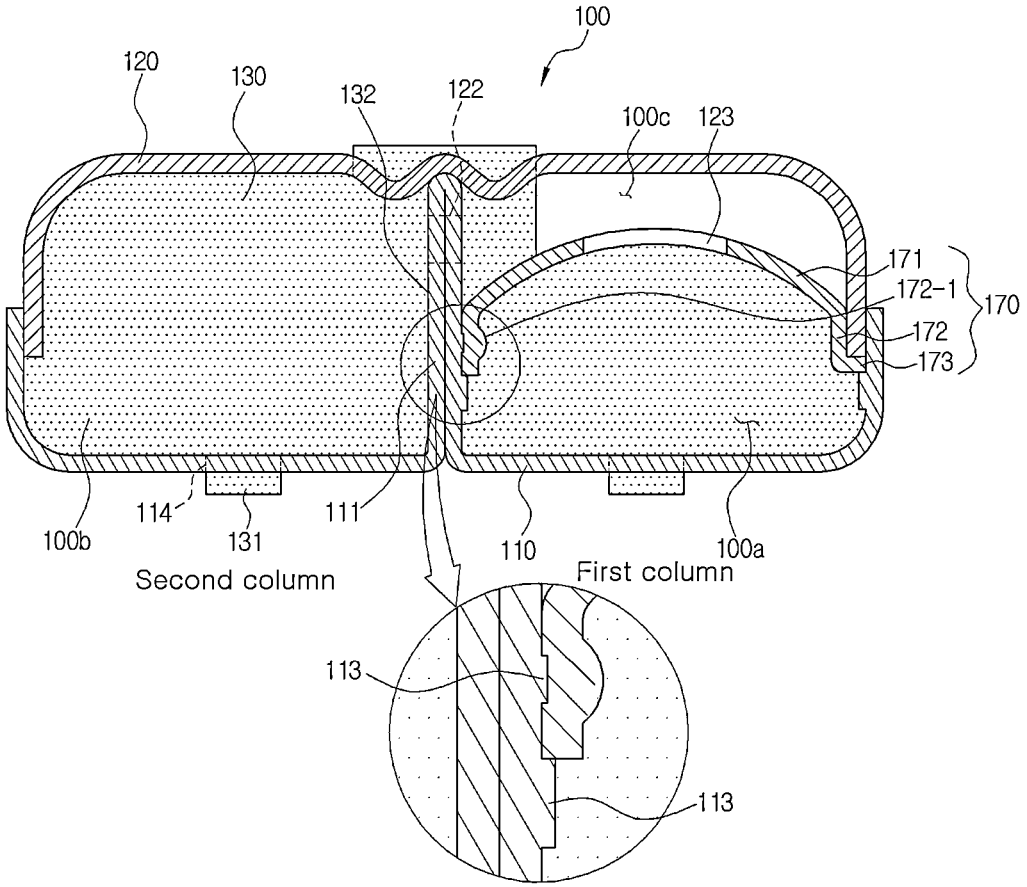

FIGS. 11 and 12 are another perspective view of the evaporator 1000 according to the present invention and a cross-sectional view of the first header tank 100 and in the evaporator 1000 illustrated in FIGS. 11 and 12, an example in which the first header tank 100 is formed by the coupling of the header 110 and the tank 120 and is provided with the flow part 100*c*, including the second formation member 170 that partitions the inside of the first compartment 100*a* in a height direction is illustrated.

The second formation member 170 may be formed, including a partition plate 171 and support surfaces 172 and the partition plate 171 partitions the inside of the first compartment 100*a* in a height direction and the support surface 172 extends from the partition plate 171 to be adhered to the barrier rib 111 or an inner surface of the tank 120.

FIGS. 11 and 12 illustrate an example in which the partition plate 171 has a curved shape and the support surface 172 extends from both portions of the partition plate 171 in a width direction and one portion thereof contacts the barrier rib 111 and the other portion thereof is formed to contact the tank 120 and the header 110.

In this case, the header 110 (including the barrier rib 111 part) of the first header tank 100 may be further formed with a second protruded bead 113 that is protruded to support the second formation member 170 so as to secure the fixing force of the second formation member 170.

As illustrated in FIG. 12, the second protruded bead 113 is protruded to the first compartment 100*a* (or the second compartment 100*b*) to support the support surface 172 or is formed on a surface adhered to the support surface 172 and may be further formed with a correspondence part 172-1 so that the support surface 172 corresponds to the surface on which the second protruded bead 113 is formed.

FIG. 12 illustrates an example in which the second protruded bead 113 may be protruded to a portion at which the barrier rib 111 of the first compartment 100*a* is formed and an opposite portion thereto, respectively, and the second protruded bead 113 (positioned at a lower portion of the second protruded bead 113 of a portion at which the barrier rib 111 of FIG. 12 is formed) that supports the lower portion of the support surface 172 and the second protruded bead 113 (positioned at an upper portion of the second protruded bead 113 of a portion at which the barrier rib 111 of FIG. 12 is formed) formed on the surface of the second support surface 172 are formed at the portion at which the barrier rib 111 is formed.

In addition, in the evaporator 1000 according to the present invention, as illustrated in FIG. 12, a bent part 173 bent so that an end of the support surface 172 surrounds the end of the tank 120 may be further provided.

Figure 13:
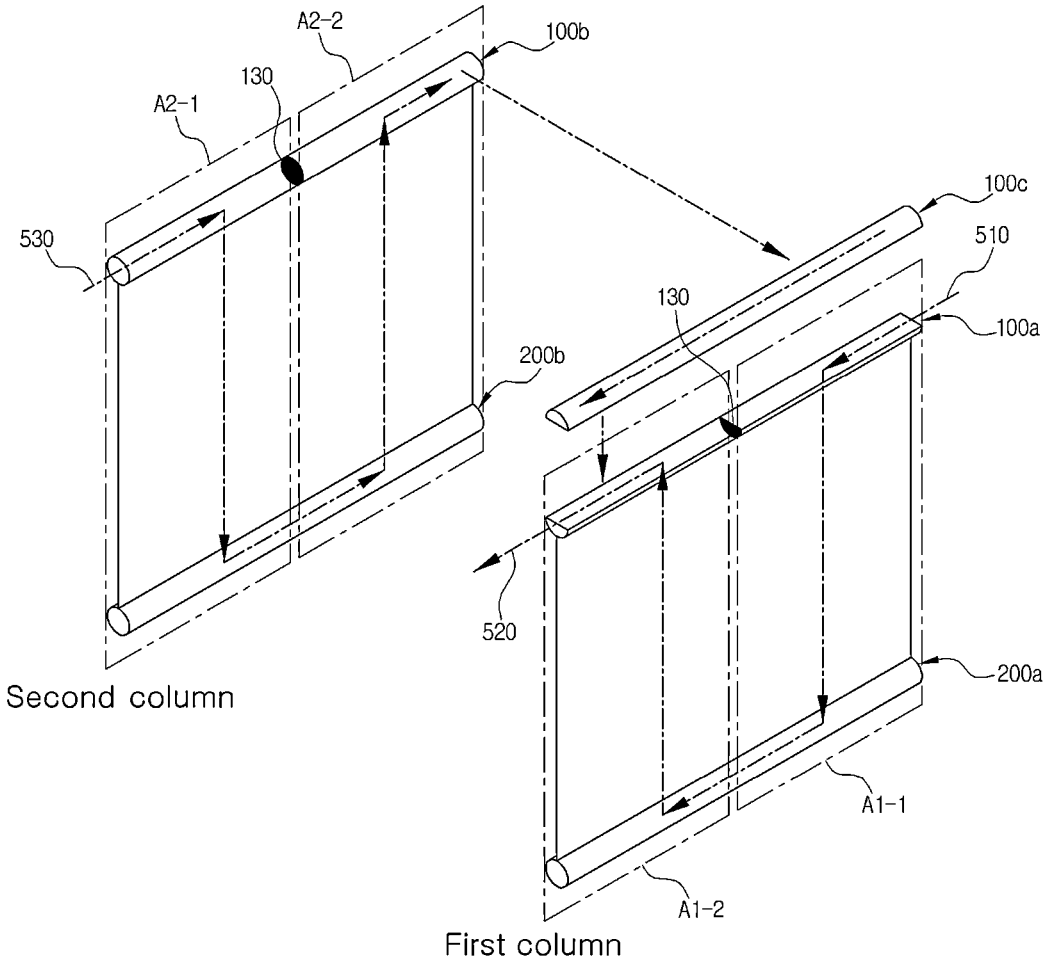
FIG. 13 is a diagram schematically illustrating an example of a refrigerant flow of the evaporator illustrated in FIG. 11.

FIG. 13 is a diagram schematically illustrating an example of the refrigerant flow of the evaporator 1000 illustrated in FIG. 11 and illustrates an example in which in the first column and the second column, the refrigerant flows are the same as the refrigerant flows illustrated in FIG. 9 and, as illustrated in FIGS. 11 and 12, the shape of the first header tank 100 is briefly applied.

Figure 14:
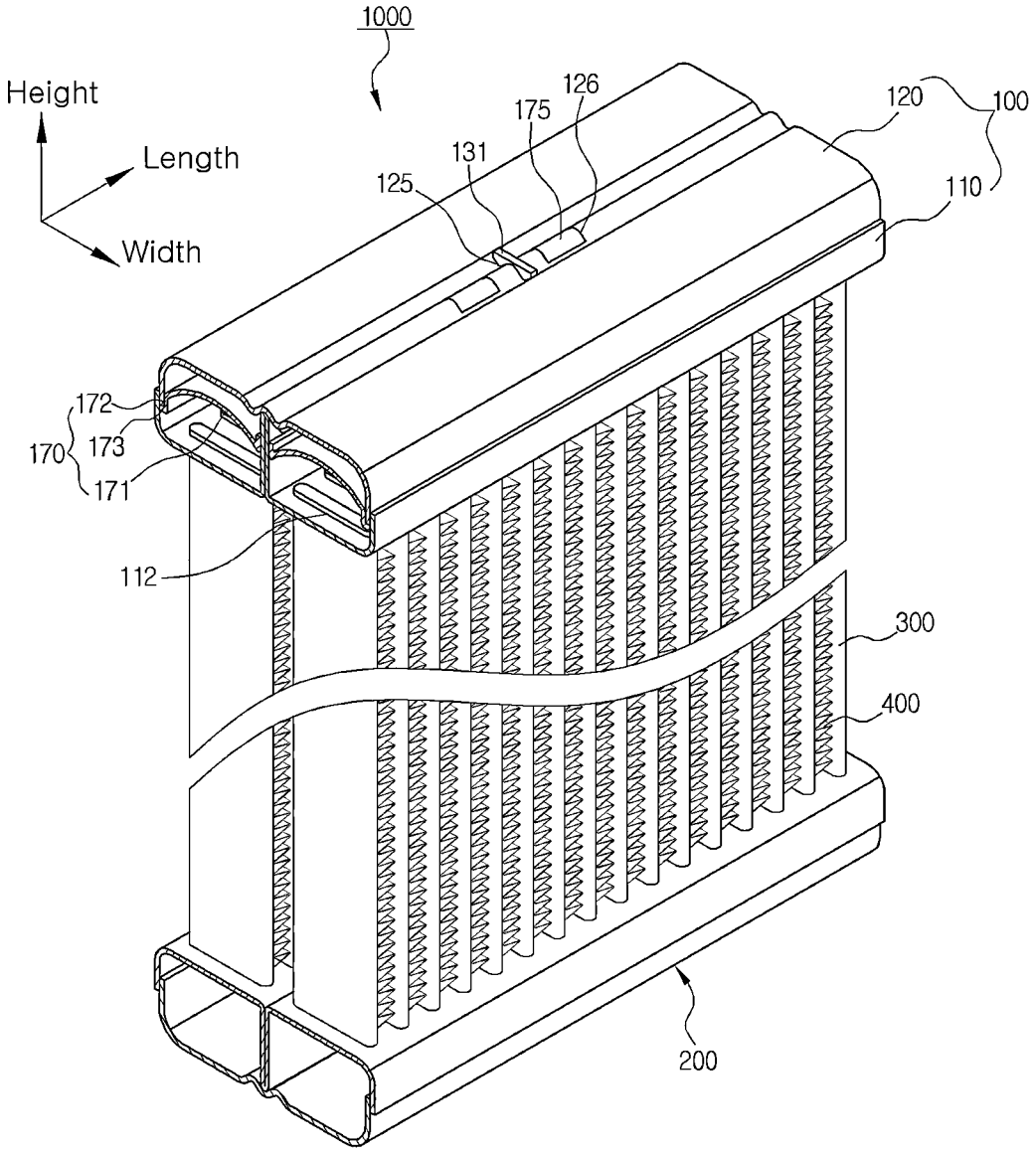
FIGS. 14 to 16 are another perspective view of an evaporator according to the present invention and an exploded perspective view and a cross-sectional view of the first header tank.
Figure 15:
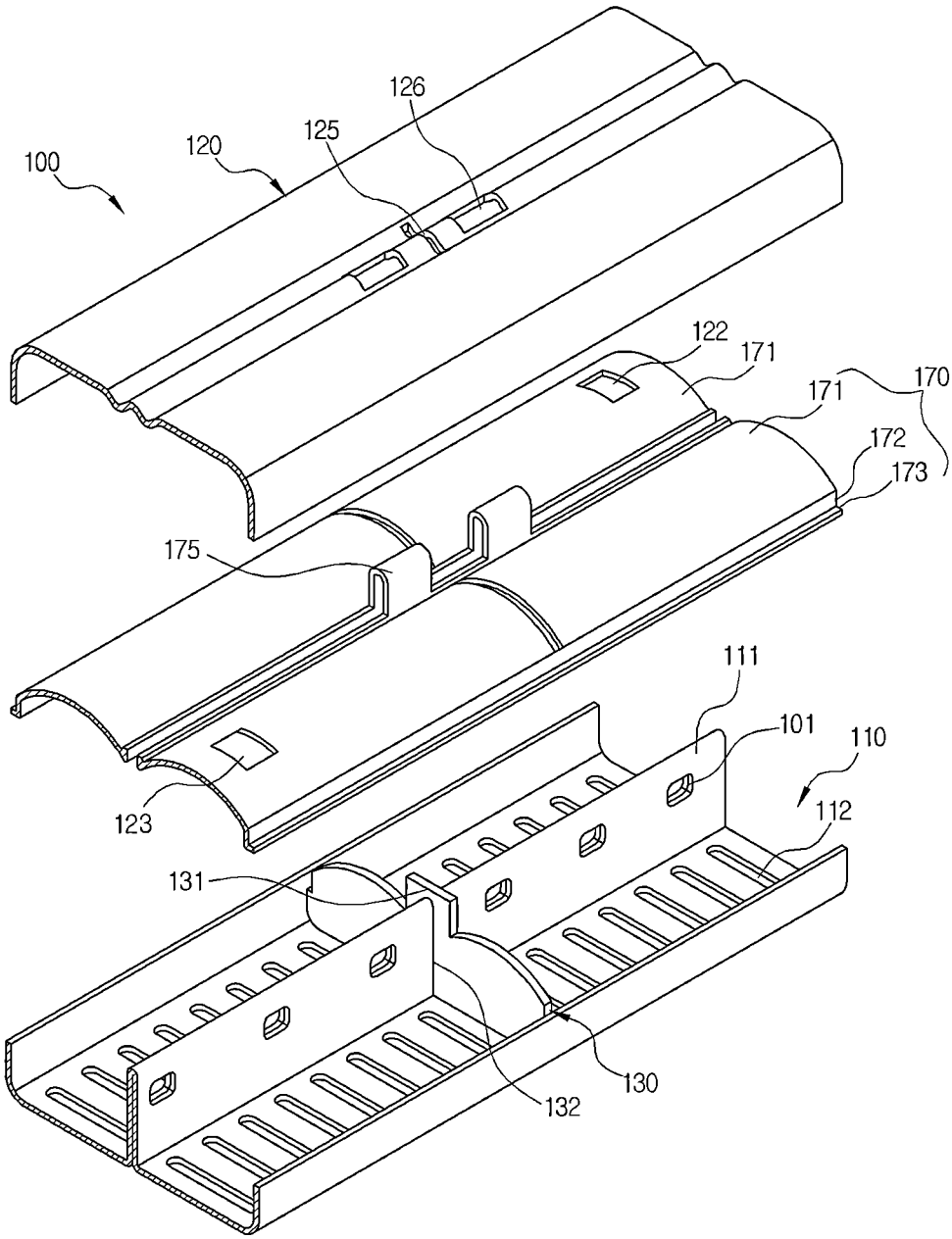
Figure 16:
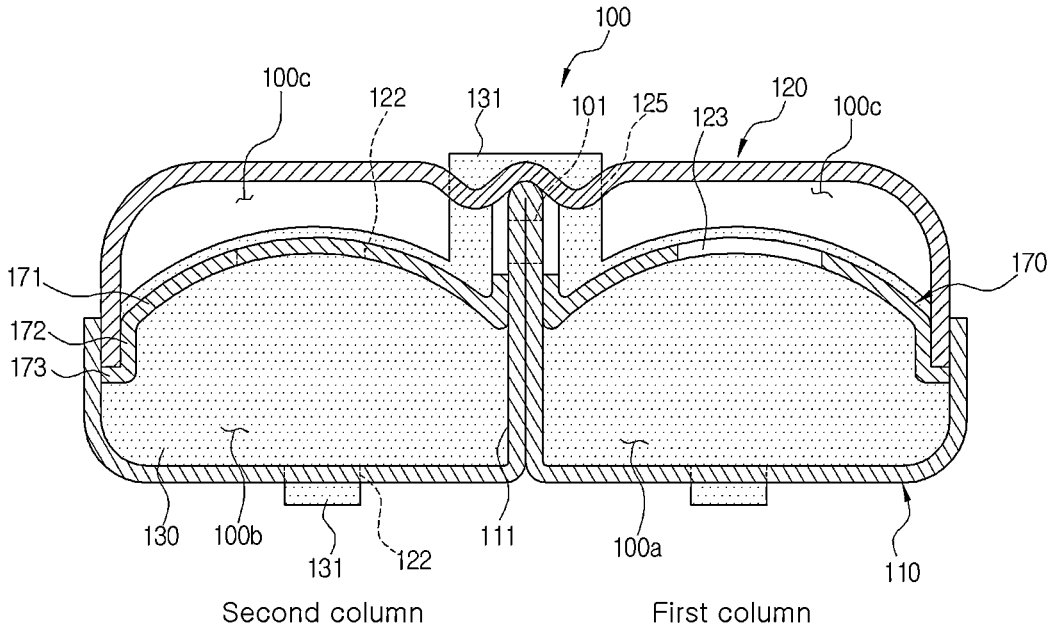

FIGS. 14 to 16 are another perspective view of the evaporator 1000 according to the present invention and an exploded perspective view and a cross-sectional view of the first header tank 100, respectively, and illustrates an example in which the flow part 100*c* is formed using the second formation member 170 which is formed to simultaneously partition the first compartment 100*a* and the second compartment 100*b* in a height direction.

FIGS. 14 to 16 illustrate an example in which the baffle 130 is provided with the first protruded part 131 in the upper and lower direction of the drawings, respectively, the header 110 is provided with a first fixed groove 114 into which the first protruded part 131 is inserted and the tank 120 is provided with a second fixed groove 125 into which the first protruded part 131 is inserted, the second formation member 170 is provided with the second protrusion 175, and the tank 120 is provided with a third fixed groove 126 into which the second protruded part 175 is inserted.

Further, an example in which a pair of the support surfaces 172 of the second formation member 170 is provided with the bent part 173 to surround the end of the tank 120 is illustrated.

In this case, the first header tank 100 of the evaporator 1000 illustrated in FIGS. 14 to 16 is formed to partition the space of the third flow part 100*c* by forming the barrier rib 111 up to a portion at which the tank 120 is formed in a height direction, and therefore a third communication hole 101 through which the spaces of the third flow part 100*c* in the first column and second column regions communicate with each other needs to be formed on the barrier rib 111.

Figure 17:
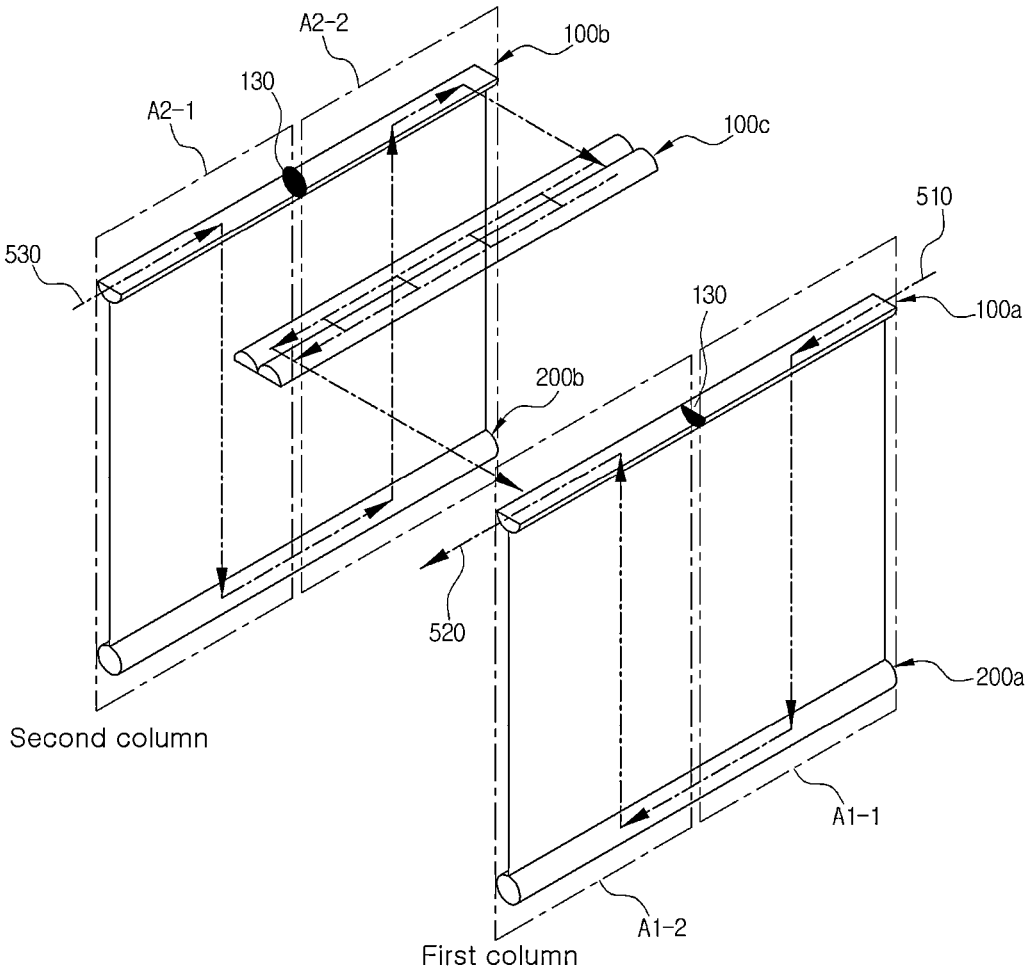
FIG. 17 is a diagram schematically illustrating an example of a refrigerant flow of the evaporator illustrated in FIG. 14.

FIG. 17 is a diagram schematically illustrating an example of the refrigerant flow of the evaporator 1000 illustrated in FIG. 14 and illustrates an example in which in the first column and the second column, the refrigerant flows are the same as the refrigerant flows illustrated in FIG. 9 and, as illustrated in FIGS. 14 to 16, the shape of the first header tank 100 is briefly applied.

Figure 18:
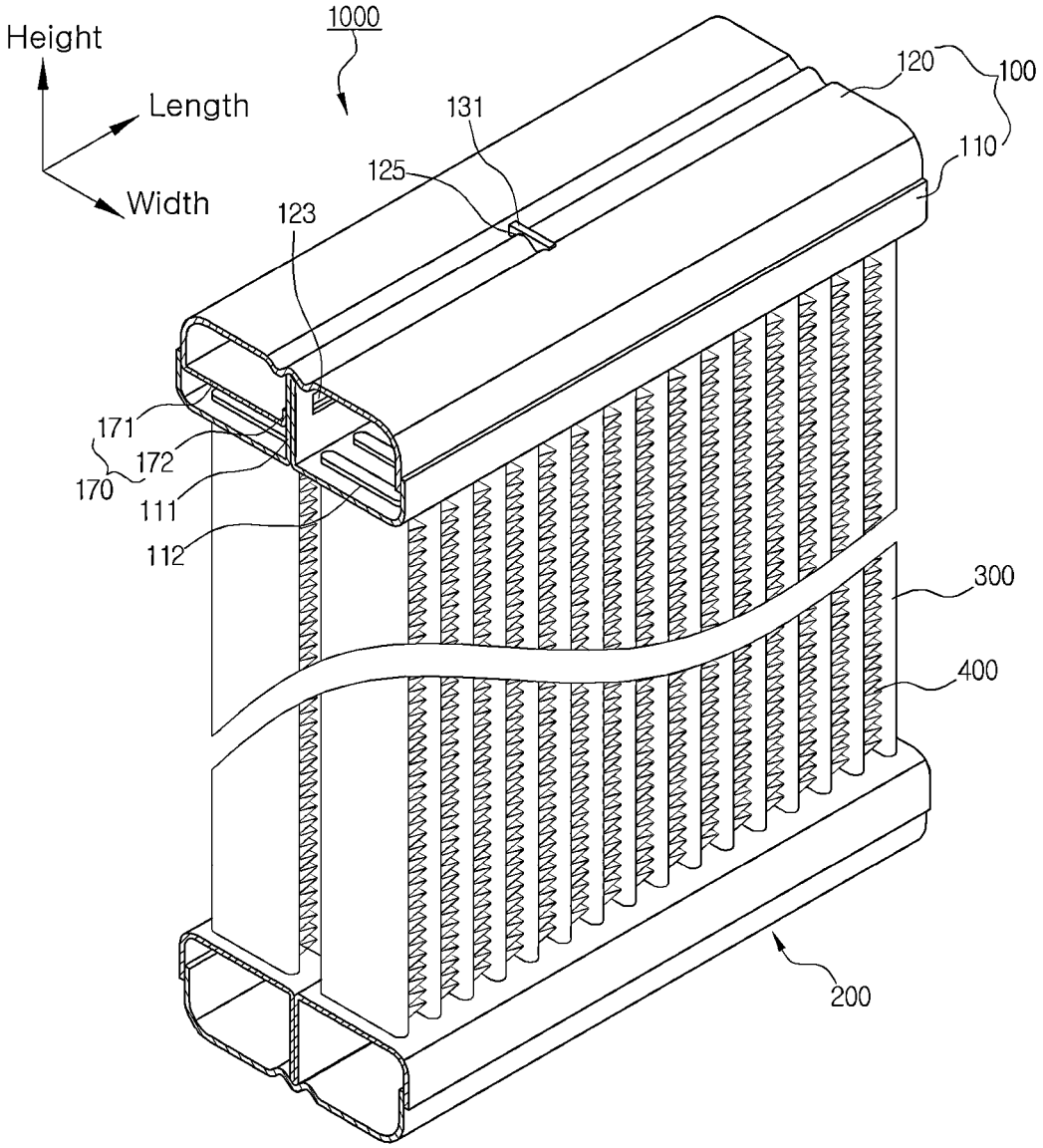
FIGS. 18 and 19 are another perspective view of an evaporator according to the present invention and a cross-sectional view of the first header tank.
Figure 19:
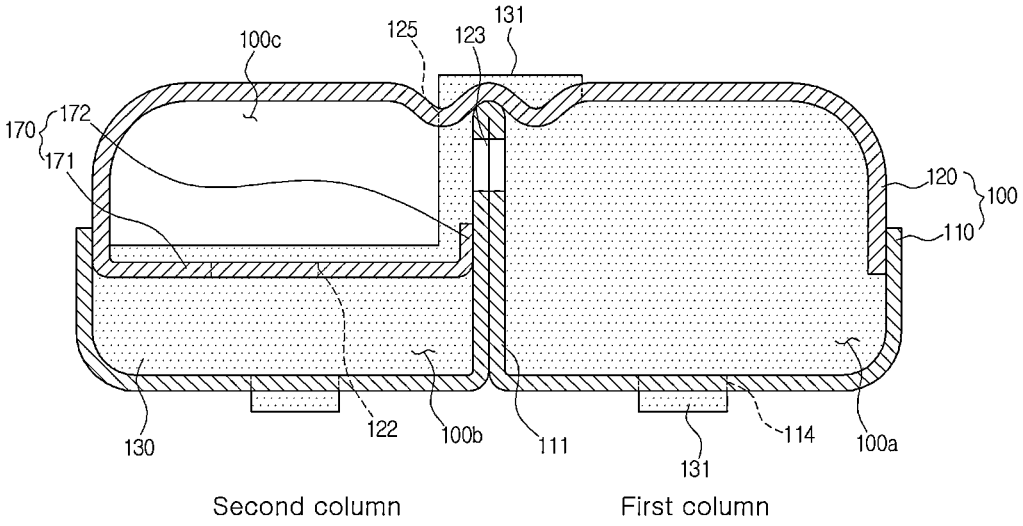

FIGS. 18 and 19 are another perspective view of the evaporator 1000 according to the present invention and a cross-sectional view of the first header tank 100 and illustrate a structure in which the second formation member 170 extends from the tank 120, that is, an example in which the second formation member 170 and the tank 120 are integrally formed.

Figure 20:
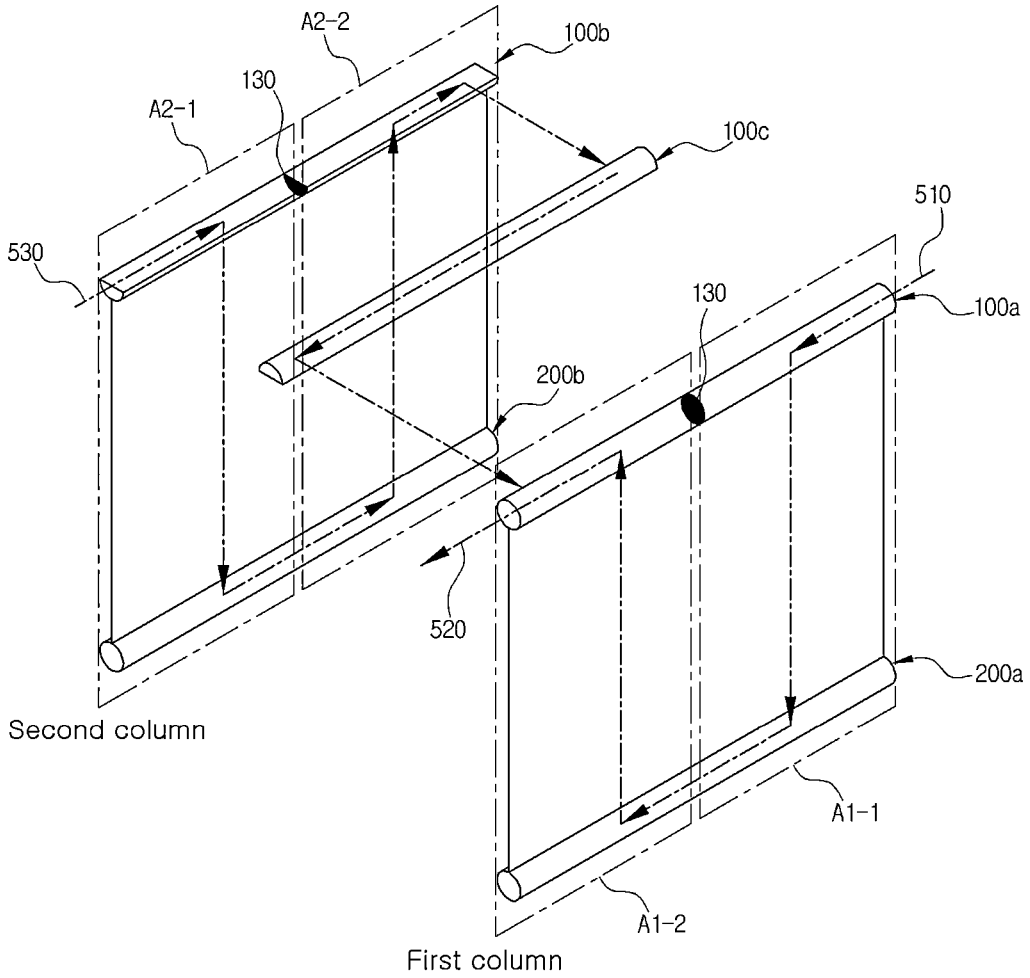
FIG. 20 is a diagram schematically illustrating an example of a refrigerant flow of the evaporator illustrated in FIG. 18.

In addition, FIG. 20 is a diagram schematically illustrating an example of the refrigerant flow of the evaporator 1000 illustrated in FIG. 18 and illustrates an example in which the refrigerant flows are the same as the refrigerant flows illustrated in FIG. 9 and, as illustrated in FIGS. 18 and 19, the shape of the first header tank 100 is briefly applied.

Figure 21:
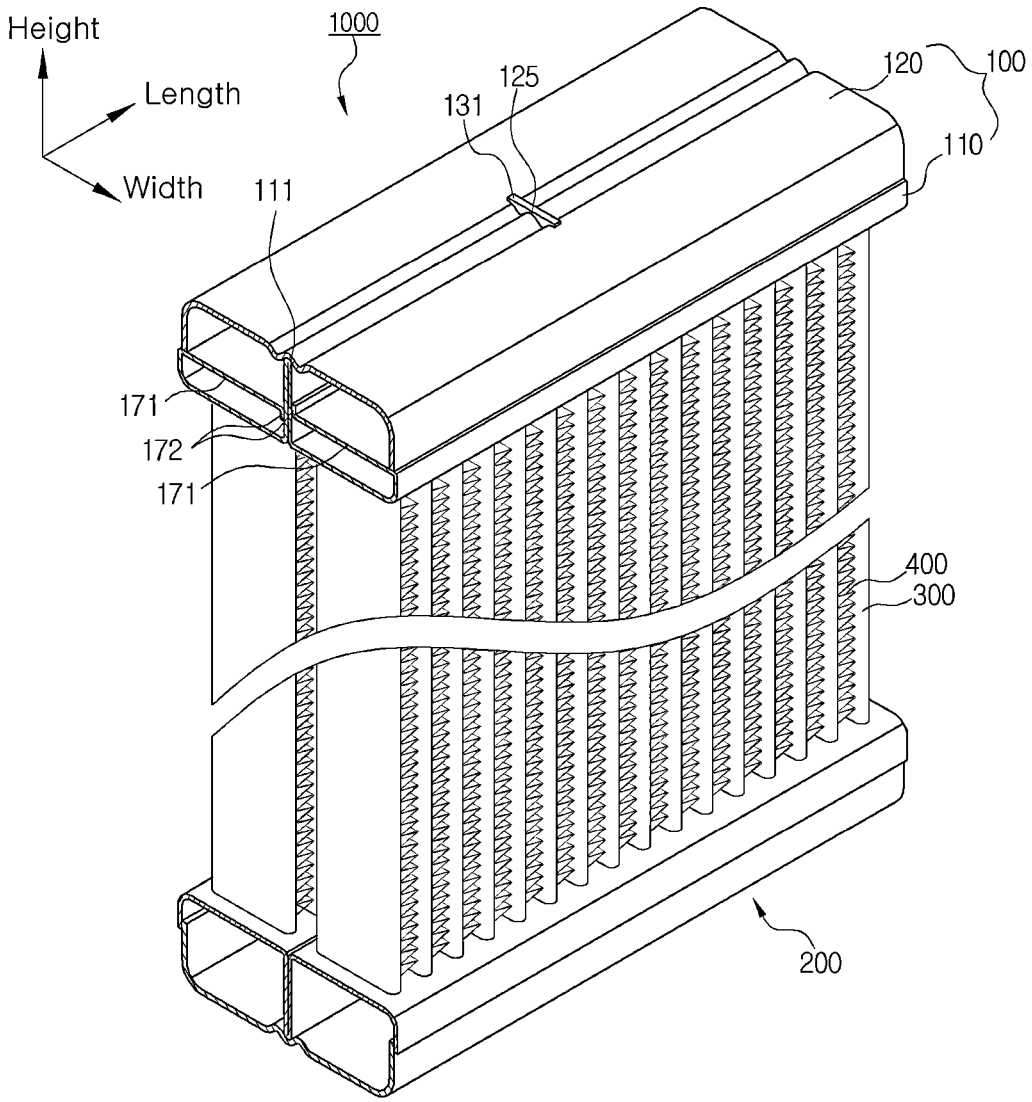
FIGS. 21 to 23 are another perspective view of an evaporator according to the present invention and an exploded perspective view of a first header tank.
Figure 22:
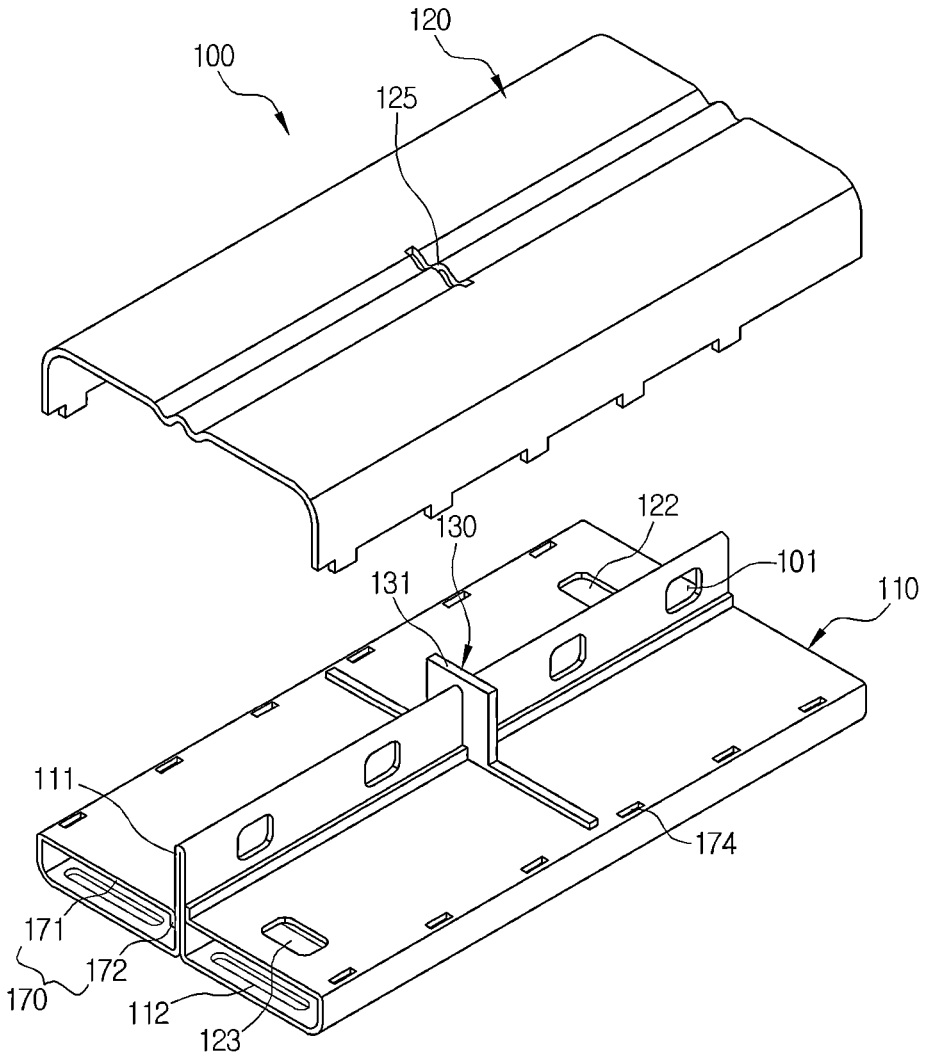
Figure 23:
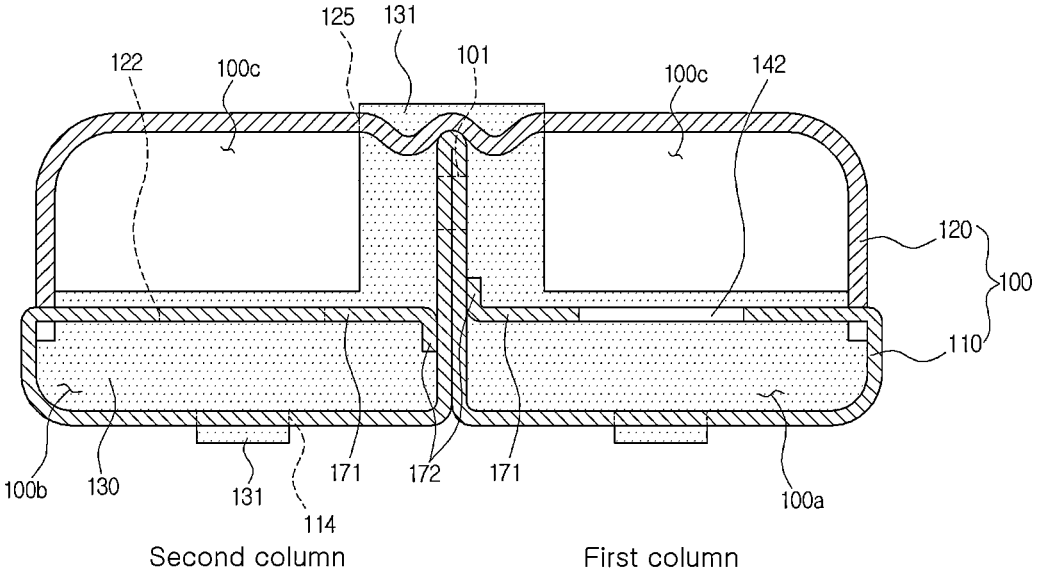

FIGS. 21 to 23 are another perspective view of the evaporator 1000 according to the present invention and an exploded perspective view and a cross-sectional view of the first header tank 100 and illustrate an example in which the second formation member 170 is integrally formed with the header 110 and the end of the tank 120 is inserted into the partition plate 171 of the second formation member 170 to fix a tank fixing groove 174.

The tank fixing groove 174 may be formed to have a predetermined region or the entire region of the tank 120 inserted thereinto and FIGS. 21 to 23 illustrate an example in which the tank fixing groove 174 is formed in plural so as to be spaced apart from each other by a predetermined distance and the end of the tank 120 is provided with a plurality of protruded regions so as to correspond to the shape of the tank fixing groove 174.

In the shape illustrated in FIGS. 21 to 23, the first communication hole 122 is formed in the partition plate 171 region corresponding to the second column of the second formation member 170, the second communication hole 123 is formed in the partition plate 171 region corresponding to the first column, and the space of the third flow part 100*c* is partitioned by the barrier wall 111 to form the third communication hole 101 on the barrier wall 111 in a hollow form.

Figure 24:
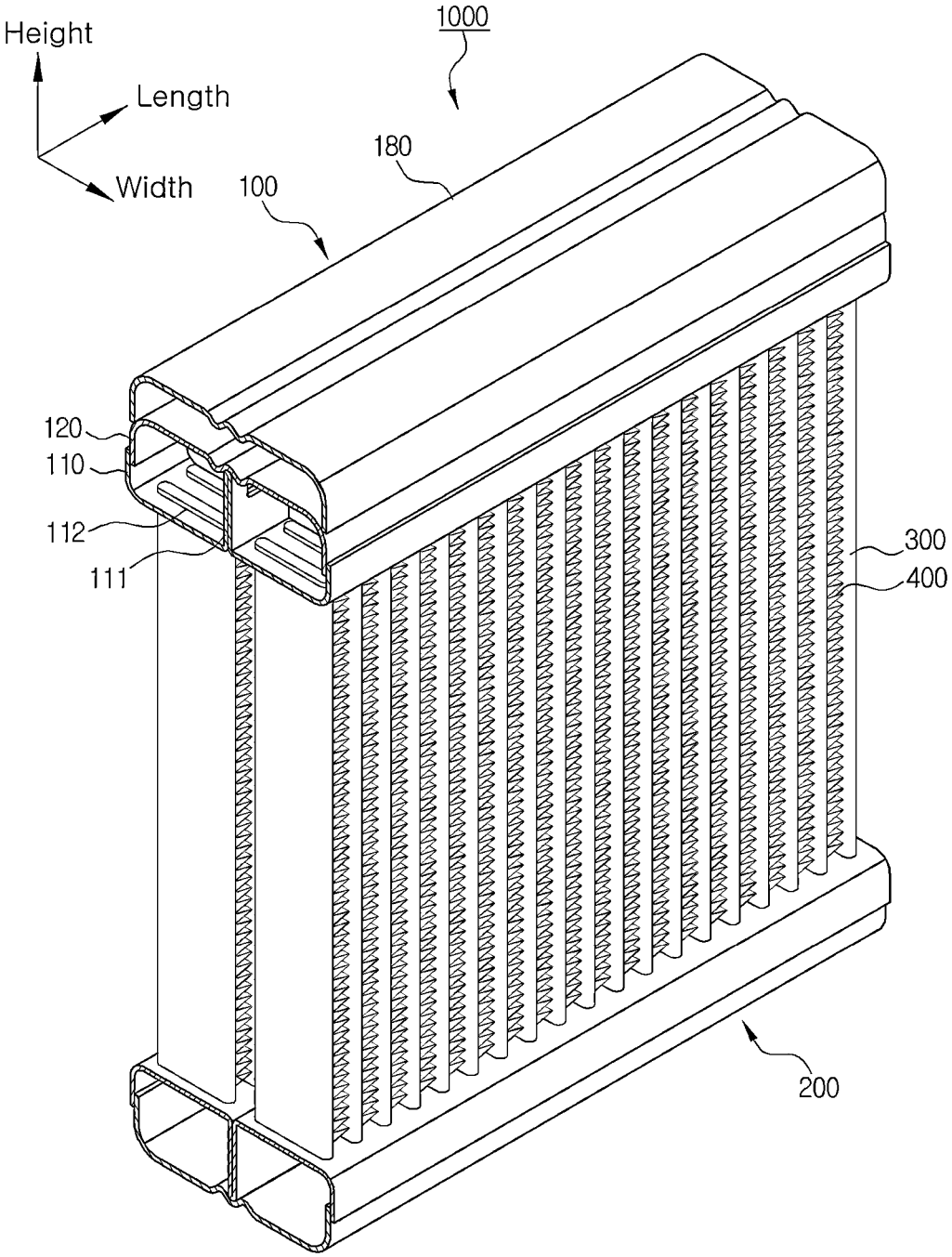
FIGS. 24 and 25 are another perspective view of an evaporator according to the present invention and a cross-sectional view of a first header tank.
Figure 25:
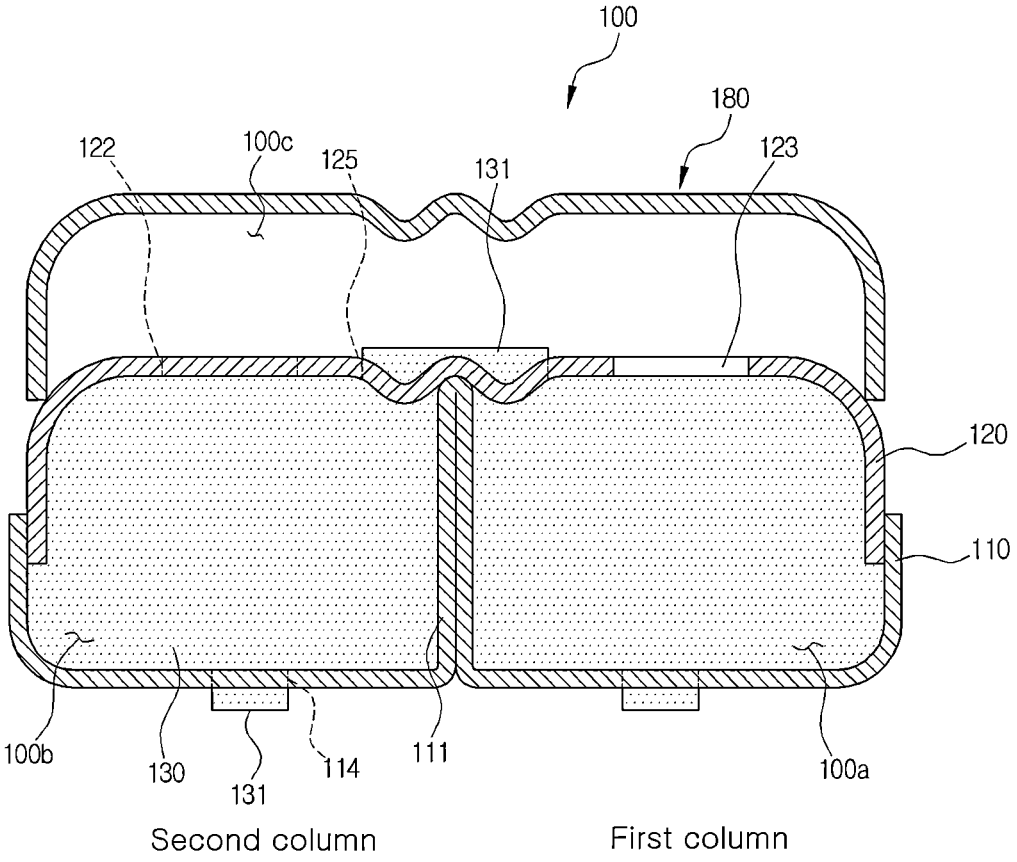

FIGS. 24 and 25 are another perspective view of the evaporator 1000 according to the present invention and a cross-sectional view of the first header tank 100 and the flow part 100*c* may be formed using the third formation member 180 that is coupled with the outer surface of the tank 120.

That is, the third formation member 180 is coupled with the outer surface of the tank 120 at the outer side of the tank 120 of the header 110 to form the third flow part 100*c* on the outer surface of the tank 120 and the interior space in which the third formation member 180 is formed.

In this case, in the shape illustrated in FIGS. 24 and 25, the first communication hole 122 is formed in the region of the tank 120 forming the second compartment 100*b* in a hollow form and the second communication hole 123 is formed in the region of the tank 120 forming the first compartment 100*a* in a hollow form.

Figure 26:
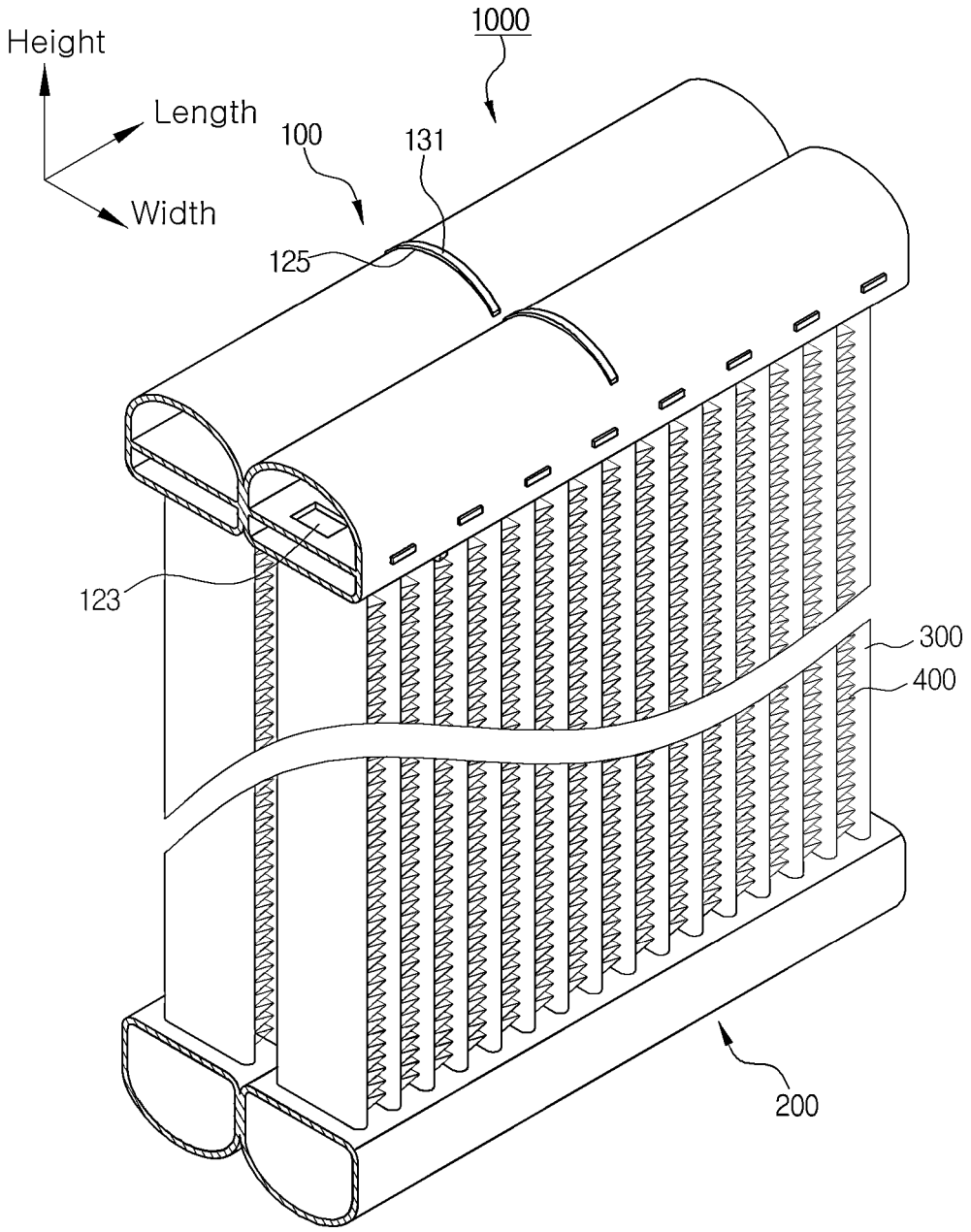
FIGS. 26 and 27 are another perspective view of an evaporator according to the present invention and a cross-sectional view of a first header tank.
Figure 27:
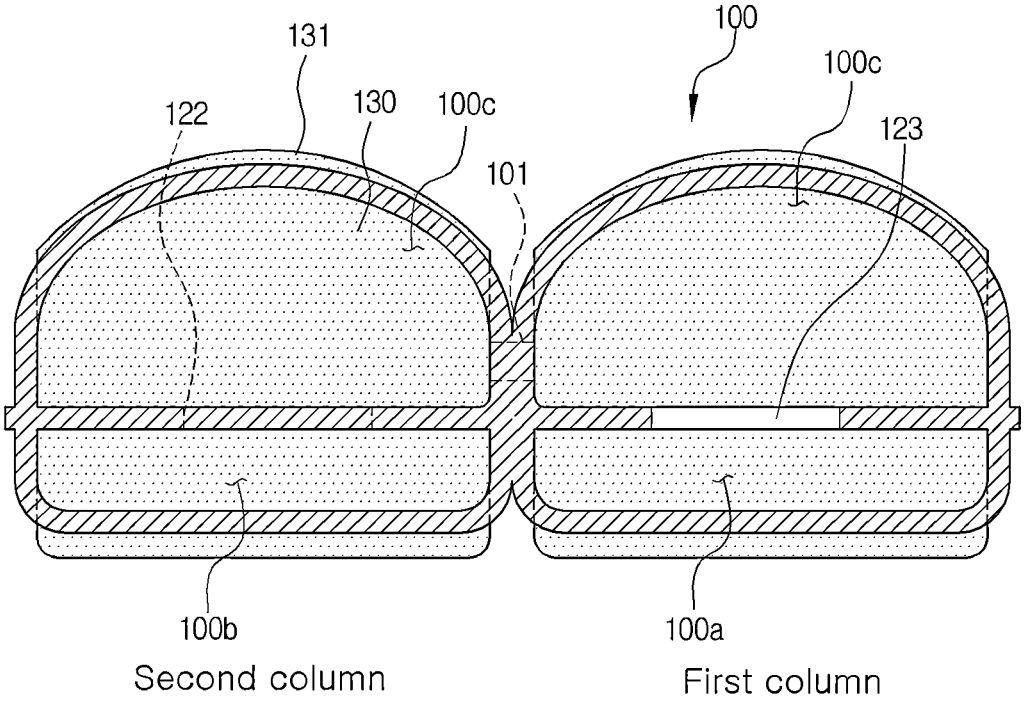
Figure 28:
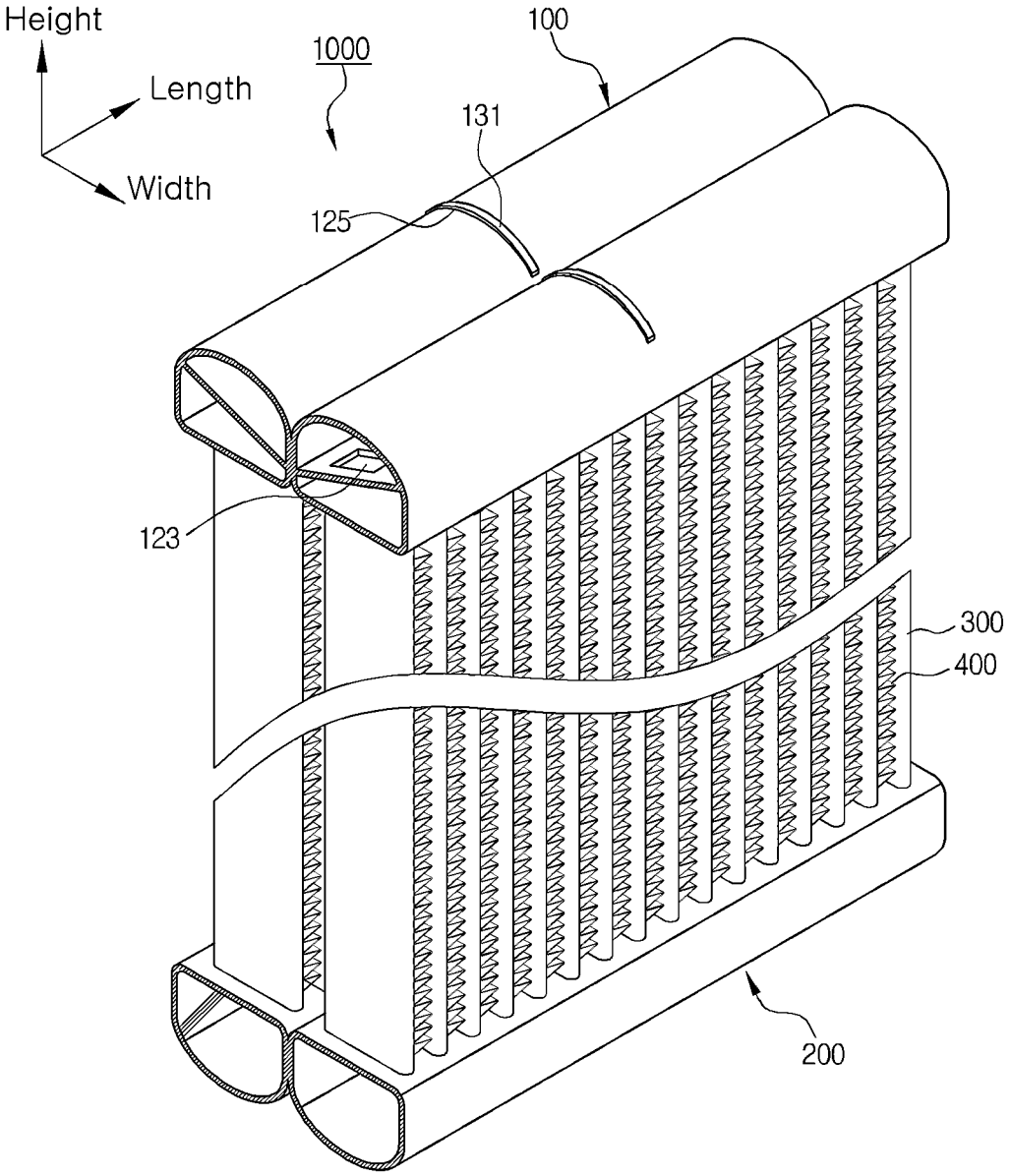
FIGS. 28 and 29 are another perspective view of an evaporator according to the present invention and a cross-sectional view of a first header tank.
Figure 29:
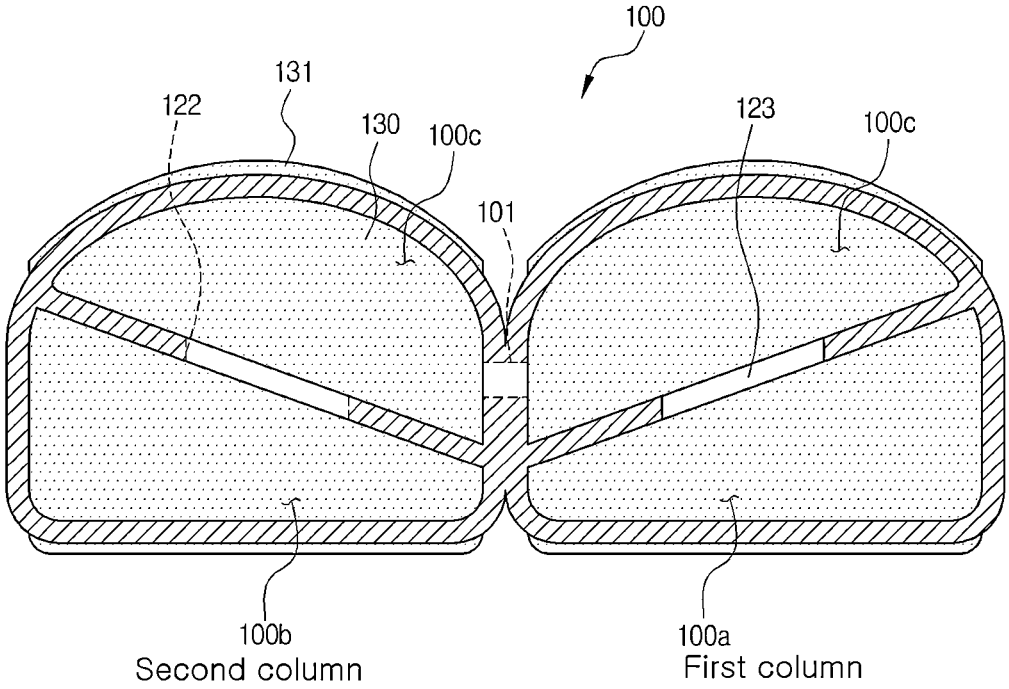

FIGS. 26 and 27 are another perspective view of the evaporator 1000 according to the present invention and a cross-sectional view of the first header tank 100, FIGS. 28 and 29 are another perspective view of the evaporator 1000 according to the present invention and a cross-sectional view of the first header tank 100, and FIGS. 26 to 29 illustrate an example in which the first header tank 100 is formed in an extrusion tank type.

In more detail, an example in which in the first header tank 100 illustrated in FIGS. 26 and 27, the space of the third flow part 100*c* separately from the spaces of the first flow part 100*a* and the second is partitioned by a surface vertically in the height direction of the drawings and the divided surface is provided with the first communication hole 122 and the second communication hole 123 is illustrated.

Further, in the first header tank 100 illustrated in FIGS. 26 and 27, the space of the third flow part 100*c* is partitioned by the barrier wall 111 to form the third communication hole through which the spaces of the two third flow parts 100*c* communicate with each other on the barrier wall 111.

Further, an example in which the first header tank 100 illustrated in FIGS. 28 and 29 is similar to the form illustrated in FIGS. 26 and 27, and the space of the third flow part 100*c* separate from the spaces of the first flow part 100*a* and the second flow part 100*b* is partitioned, but is partitioned by a surface inclined to the upper portion in the height direction based on the barrier wall 111 is illustrated.

FIGS. 26 to 29 illustrate an embodiment in which the first header tank 100 is formed in an extrusion tank type and the evaporator 1000 according to the present invention is not limited thereto and the evaporator 100 may be modified in various forms having the first flow part 100*a*, the second flow part 100*b*, and the third flow part 100*c*.

Meanwhile, like the first header tank 100, the second header tank 200 may also be formed by the coupling of the header 100 and the tank 120 and may also be formed in the extrusion tank type.

In addition, in the evaporator 1000 according to the present invention, the second header tank 200 is partitioned by the barrier rib 111 to have the first column and the second column formed therein, such that the first compartment 100*a* and the second compartment 100*b*, respectively, are formed in a width direction and if the evaporator 1000 has a form in which at least one baffle 130 that partitions the space in a length direction is provided, the evaporator 1000 may be more variously modified.

Therefore, the evaporator 1000 according to the present invention relates to the double evaporator 1000 in which the refrigerant flows in the first column and the second column, respectively, in which the refrigerant channel structure may be improved by forming the flow part 100*c* having the refrigerant flow therein using the formation members 160, 170, and 180, separately, the first compartment 100*a* and the second compartment 100*b*, such that each of the first column and the second column is provided with the inlet and the outlet 520, thereby reducing the total number of four inlets and outlets that are disposed in the first column and the second column, respectively.

Therefore, the evaporator 1000 according to the present invention can reduce the number of components and simplify the assembly process to improve the production efficiency and reduce the number of outlets 520 as compared with the related art to more reduce the number of connection pipe lines, thereby realizing the miniaturization.

According to the present invention, the evaporator includes the flow part having a refrigerant flow therein, separately from the first compartment and the second compartment to improve the refrigerant channel structure in the double evaporator in which the refrigerant flows in the first column and the second column, respectively, thereby reducing the number of four inlets and outlets that are disposed in the first column and the second column, respectively.

Therefore, the evaporator according to the present invention can reduce the number of components and simplify the assembly process to improve the production efficiency and reduce the number of outlets as compared with the related art to more reduce the number of connection pipe lines, thereby realizing the miniaturization.

In particular, the evaporator according to the present invention can propose the detailed embodiments for forming the flow part, improve the refrigerant channel structure by forming the flow part, and simplify the manufacturing process, thereby increasing the productivity.

The present invention is not limited to the above-mentioned exemplary embodiments, and may be variously applied, and may be variously modified without departing from the gist of the present invention claimed in the claims.

What is claimed is:

1. An evaporator, comprising:

a first header tank and a second header tank disposed in parallel with each other, being spaced apart from each other by a predetermined distance and including at least one baffle that is partitioned by a barrier rib to form a first column and a second column to partition each of a first compartment and a second compartment in a width direction and partition a space in a length direction;

a plurality of tubes, each of which having both ends fixed to the first header tank and the second header tank, respectively; and a pin interposed between the plurality of tubes, wherein the first header tank is lengthily formed with a flow part in the length direction, the flow part being disposed separately from the first compartment and the second compartment.

2. The evaporator of claim 1, wherein the first header tank includes:

a first inlet connected with one portion of the first compartment and configured to introduce a refrigerant;

an outlet connected with another portion of the first compartment and configured to discharge the refrigerant; and a second inlet connected with one portion of the second compartment and configured to introduce the refrigerant, wherein the flow part comprises a first communication hole that is adjacent to a formation region of the first inlet in the length direction to communicate with the second compartment and a second communication hole that is adjacent to a formation region of the outlet and the second inlet in the length direction to communicate with the first compartment.

3. The evaporator of claim 2, further comprising:

a first region disposed in the first column, wherein the refrigerant introduced into the first compartment of the first header tank through the first inlet moves to the first compartment of the second header tank through at least one of the plurality of tubes and a second region in which the refrigerant of the first compartment of the second header tank moves to the first compartment of the first header tank through at least one of the plurality of tubes; and third region disposed in the second column in which the refrigerant introduced into the second compartment of the first header tank through the second inlet moves to the second compartment of the second header tank through at least one of the plurality of tubes and a fourth region in which the refrigerant of the second compartment of the second header tank moves to the second compartment of the first header tank through at least one of the plurality of tubes, and the refrigerant passing through both of the third region and the fourth region of the second column moves to the flow part through the first communication hole and moves in the length direction and is joined with the refrigerant discharged through the first region and the second region of the first column through the second communication hole to be discharged through the outlet.

4. The evaporator of claim 1, wherein the first header tank includes a header and a tank coupled to one another.

5. The evaporator of claim 4, wherein the tank of the first header tank is formed in the width direction and includes a depressed part being lengthily formed in the length direction, wherein a central region of the depressed part is formed with the barrier rib, and wherein the first header tank includes a first formation member disposed to cover the depressed part of the tank, so that a portion surrounded by the depressed part of the tank and a first formation member form the flow part.

6. The evaporator of claim 5, wherein the tank is inclined to the barrier rib so that the depressed part has a "Y"-letter shape along with the barrier rib.

7. The evaporator of claim 5, wherein the first header tank includes at least one first protruded bead that is protruded to the flow part to support the first formation member is disposed on the depressed part.

8. The evaporator of claim 7, wherein the first formation member includes extensions that extend to contact at least two of the surfaces of the first protruded beads vertically to the length direction of the first header tank.

9. The evaporator of claim 5, wherein both ends of the first header tank include an end cap including a plate part and a support part that is protruded in a form in which a predetermined region of the plate part corresponds to a space of the flow part to support the first formation member.

10. The evaporator of claim 9, wherein one of the end caps disposed at both ends of the first header tank includes a first hollow hole of which a predetermined region corresponding to the first compartment in the predetermined region of the plate part is hollowed and a second hollow hole of which a predetermined region corresponding to the second compartment in the predetermined region of the plate part is hollowed, and the other one of the end caps includes a third hollow hole of which a predetermined region corresponding to the first compartment in the predetermined region of the plate part is hollowed.

11. The evaporator of claim 4, wherein the first header tank has the flow part including a second formation member that partitions one portion or both portions of the first compartment and the second compartment formed by the coupling of the header and the tank in a height direction.

12. The evaporator of claim 11, wherein the second formation member includes:

a partition plate that partitions one portion or both portions of the first compartment and the second compartment in the height direction; and a support surface that extends from the partition plate to be adhered to the barrier rib and an inner surface of the first header tank.

13. The evaporator of claim 12, wherein the header of the first header tank includes a second protruded bead that is protruded so as to support the second formation member.

14. The evaporator of claim 13, wherein, in the first header tank, the support surface of the second formation member is adhered to the inner surface of the first header tank and a bent part bent so that the predetermined region of the end surrounds the end of the first header tank is formed.

15. The evaporator of claim 12, wherein the second formation member extends from the first header tank.

16. The evaporator of claim 12, wherein the second formation member extends from the header.

17. The evaporator of claim 16, wherein the first header tank includes a partition plate of the second formation member that extends from the header, the partition plate having a tank fixing groove and wherein both ends of the tank are inserted into the tank fixing groove.

18. The evaporator of claim 4, wherein the first header tank includes a third formation member coupled with an outer surface of the tank to form the flow part formed therein.

19. The evaporator of claim 1, wherein the first header tank is formed in an extrusion tank type.

* * * * *